US012565726B2

(12) United States Patent
Lee et al.

(10) Patent No.: US 12,565,726 B2
(45) Date of Patent: Mar. 3, 2026

(54) WASHING MACHINE AND METHOD FOR CONTROLLING THE SAME

(71) Applicant: SAMSUNG ELECTRONICS CO., LTD., Suwon-si (KR)

(72) Inventors: Sungmo Lee, Suwon-si (KR); Junhyun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 111 days.

(21) Appl. No.: 18/666,697

(22) Filed: May 16, 2024

(65) Prior Publication Data

US 2024/0410099 A1 Dec. 12, 2024

Related U.S. Application Data

(63) Continuation of application No. PCT/KR2024/095693, filed on Apr. 9, 2024.

(30) Foreign Application Priority Data

Jun. 12, 2023 (KR) ..... 10-2023-0075151

(51) Int. Cl.

| | |
|---|---|
| ***D06F 33/48*** | (2020.01) |
| ***D06F 33/40*** | (2020.01) |
| ***D06F 37/30*** | (2020.01) |
| *D06F 103/26* | (2020.01) |
| *D06F 105/46* | (2020.01) |

(52) U.S. Cl.

CPC ..... *D06F 33/48* (2020.02); *D06F 33/40* (2020.02); *D06F 37/304* (2013.01); *D06F 2103/26* (2020.02); *D06F 2105/46* (2020.02)

(58) Field of Classification Search

CPC ..... D06F 33/48

See application file for complete search history.

(56) References Cited

U.S. PATENT DOCUMENTS 7,145,310 B2 12/2006 Ihm et al.
7,728,536 B2 6/2010 Katsumata et al.
(Continued)

FOREIGN PATENT DOCUMENTS

JP 6752871 B2 9/2020
KR 20060070205 A 6/2006
(Continued)

OTHER PUBLICATIONS

International Search Report and Written Opinion of the International Searching Authority dated Jul. 30, 2024, in connection with International Application No. PCT/KR2024/095693, 10 pages.

*Primary Examiner* — Jason Y Ko

(57) ABSTRACT

A washing machine includes: a drum configured to be rotatable inside a tub; a motor including a stator and a rotor, and configured to rotate the drum; an inverter circuit connected to the motor; and at least one processor configured to compensate for a q-axis current command value of the motor based on an $m^{th}$-order harmonic component (m is a natural number) and a position of the rotor, and control the inverter circuit to drive the motor based on the compensated q-axis current command value, the $m^{th}$-order harmonic component being filtered by a bandpass filter from a speed error value of the rotor.

20 Claims, 13 Drawing Sheets

(56) References Cited

U.S. PATENT DOCUMENTS

| | | | |
|---|---|---|---|
| 8,446,115 | B2 | 5/2013 | Yabuguchi et al. |
| 9,644,305 | B2 | 5/2017 | Kim |
| 10,483,897 | B2 | 11/2019 | Deguchi et al. |
| 11,139,766 | B2 | 10/2021 | Endo et al. |
| 11,271,503 | B2 | 3/2022 | Endo et al. |
| 2015/0184324 | A1 | 7/2015 | Mo |

FOREIGN PATENT DOCUMENTS

| | | | |
|---|---|---|---|
| KR | 20070058579 | A | 6/2007 |
| KR | 20140097647 | A | 8/2014 |
| KR | 10-1846968 | B1 | 4/2018 |
| KR | 20190104718 | A | 9/2019 |
| KR | 20200112504 | A | 10/2020 |
| KR | 20210008746 | A | 1/2021 |

WASHING MACHINE AND METHOD FOR CONTROLLING THE SAME

CROSS-REFERENCE TO RELATED APPLICATIONS

This application is a Bypass Continuation of International Application No. PCT/KR2024/095693, filed on Apr. 9, 2024, which is based on and claims priority of a Korean Patent Application No. 10-2023-0075151, filed on Jun. 12, 2023, in the Korean Intellectual Property Office, the disclosure of which are incorporated by reference herein in their entirety.

BACKGROUND

1. Field

The disclosure relates to a washing machine and a method for controlling the same, and more specifically, to a washing machine including a motor rotating a drum and a method for controlling the same.

2. Description of Related Art

In general, a washing machine may include a tub, a drum rotatably installed in the tub, and a motor rotating the drum, and may wash laundry by rotating the drum containing laundry inside the tub. The washing machine may perform a wash process of washing laundry, a rinse process of rinsing the washed laundry, and a spin-dry process of spin-drying the laundry.

In the spin-dry process, water absorbed in the laundry may be separated from the laundry by rotating the drum containing the laundry at high speed by controlling the motor.

Motors may generate cogging torque due to magnetic force interaction between a rotor and a stator. Cogging torque generates torque ripple in the form of specific harmonic components, causing torque fluctuations in the motor.

Motor torque fluctuations may cause vibration and impact of the motor, resulting in motor noise. The motor noise is transmitted to surrounding structures connected to the motor, and may be significantly amplified when the motor noise coincides with a natural resonant frequency of the surrounding structures.

SUMMARY

An aspect of the disclosure provides a washing machine that may reduce noise of a motor by offsetting harmonic components generated by the motor, and a method for controlling the same.

Technical objects that may be achieved by the disclosure are not limited to the above-mentioned objects, and other technical objects not mentioned will be clearly understood by one of ordinary skill in the art to which the disclosure belongs from the following description.

According to an aspect of the disclosure, a washing machine may include: a drum configured to be rotatable inside a tub; a motor including a stator and a rotor, and configured to rotate the drum; an inverter circuit connected to the motor; and at least one processor configured to compensate for a q-axis current command value of the motor based on an $m^{th}$-order harmonic component (m is a natural number) and a position of the rotor, and control the inverter circuit to drive the motor based on the compensated q-axis current command value, the $m^{th}$-order harmonic component being filtered by a bandpass filter from a speed error value of the rotor.

According to an aspect of the disclosure, a method for controlling a washing machine including a drum configured to be rotatable inside a tub, and a motor including a stator and a rotor and configured to rotate the drum, the method may include: filtering, by a bandpass filter, a preset $m^{th}$-order harmonic component (m is a natural number) from a speed error value of the rotor; compensating for a q-axis current command value of the motor based on the filtered $m^{th}$-order harmonic component and a position of the rotor; and driving the motor based on the compensated q-axis current command value.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
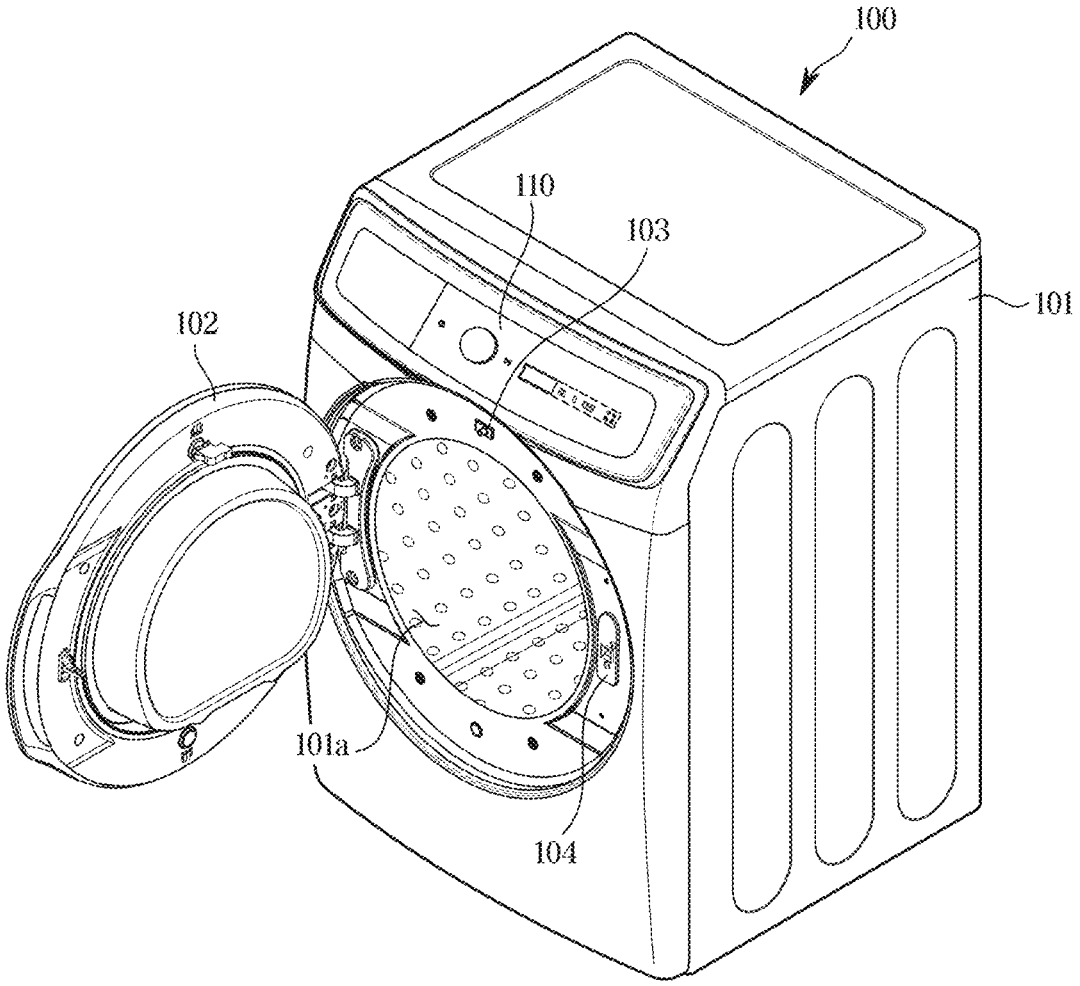
FIG. 1 illustrates an exterior of a washing machine according to an embodiment.

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Various embodiments of the disclosure and terms used therein are not intended to limit the technical features described in the disclosure to particular embodiments, and it should be construed as including various modifications, equivalents, or alternatives of a corresponding embodiment.

With regard to description of drawings, similar reference numerals may be used for similar or related components.

A singular expression may include a plural expression unless otherwise indicated herein or clearly contradicted by context.

The expressions "A or B," "at least one of A or/and B," or "one or more of A or/and B," A, B or C," "at least one of A, B or/and C," or "one or more of A, B or/and C," and the like used herein may include any and all combinations of one or more of the associated listed items.

The term of "and/or" includes a plurality of combinations of relevant items or any one item among a plurality of relevant items.

Herein, the expressions "a first", "a second", "the first", "the second", etc., may simply be used to distinguish an element from other elements, but is not limited to another aspect (e.g., importance or order) of elements.

When an element (e.g., a first element) is referred to as being "(functionally or communicatively) coupled," or "connected" to another element (e.g., a second element), the first element may be connected to the second element, directly (e.g., wired), wirelessly, or through a third element.

In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

When an element is said to be "connected", "coupled", "supported" or "contacted" with another element, this includes not only when elements are directly connected, coupled, supported or contacted, but also when elements are indirectly connected, coupled, supported or contacted through a third element.

Throughout the description, when an element is "on" another element, this includes not only when the element is in contact with the other element, but also when there is another element between the two elements.

A washing machine according to various embodiments may perform washing, rinsing, spin-drying, and drying processes. The washing machine is an example of a clothes care apparatus, and the clothes care apparatus is a concept including a device capable of washing clothes (objects to be washed, and objects to be dried), a device capable of drying clothes, and a device capable of washing and drying clothes.

The washing machine according to various embodiments may include a top-loading washing machine in which a laundry inlet for inserting or withdrawing laundry is provided to face upward, or a front-loading washing machine in which a laundry inlet is provided to face forward. The washing machine according to various embodiments may include a washing machine that is in a loading type other than the top-loading washing machine and the front-loading washing machine.

In the top-loading washing machine, laundry may be washed using water current generated by a rotating body such as a pulsator. In the front-loading washing machine, laundry may be washed by repeatedly lifting and lowering laundry by rotating a drum. The front-loading washing machine may include a dryer combined washing machine capable of drying laundry stored in a drum. The dryer combined washing machine may include a hot air supply device for supplying high-temperature air into the drum and a condensing device for removing moisture from air discharged from the drum. For example, the dryer combined washing machine may include a heat pump device. The washing machine according to various embodiments may include a washing machine using a washing method other than the above-described washing method.

The washing machine according to various embodiments may include a housing accommodating various components therein. The housing may be provided in the form of a box including a laundry inlet on one side thereof.

The washing machine may include a door for opening and closing the laundry inlet. The door may be rotatably mounted to the housing by a hinge. At least a portion of the door may be transparent or translucent to allow the inside of the housing to be seen.

The washing machine may include a tub arranged inside the housing to store water. The tub may be formed in a substantially cylindrical shape with a tub opening formed at one side thereof. The tub may be disposed inside the housing in such a way that the tub opening corresponds to the laundry inlet.

The tub may be connected to the housing by a damper. The damper may absorb vibration generated when the drum rotates, and the damper may reduce vibration transmitted to the housing.

The washing machine may include a drum provided to accommodate laundry.

The drum may be disposed inside the tub in such a way that a drum opening provided at one side of the drum corresponds to the laundry inlet and the tub opening. Laundry may pass through the laundry inlet, the tub opening, and the drum opening, sequentially and then be accommodated in the drum or withdrawn from the drum.

The drum may perform each operation according to washing, rinsing, and/or spin-drying while rotating inside the tub. A plurality of through holes may be formed in a cylindrical wall of the drum to allow water stored in the tub to be introduced into or to be discharged from the drum.

The washing machine may include a driver configured to rotate the drum. The driver may include a drive motor and a rotating shaft for transmitting a driving force generated by the drive motor to the drum. The rotating shaft may penetrate the tub to be connected to the drum.

The driver may perform respective operations according to washing, rinsing, and/or spin-drying, or drying processes by rotating the drum in a forward or reverse direction.

The washing machine may include a water supply configured to supply water to the tub. The water supply may include a water supply pipe and a water supply valve disposed in the water supply pipe. The water supply pipe may be connected to an external water supply source. The water supply pipe may extend from an external water supply source to a detergent supply device and/or the tub. Water may be supplied to the tub through the detergent supply device. Alternatively, water may be supplied to the tub without passing through the detergent supply device.

The water supply valve may open or close the water supply pipe in response to an electrical signal of a control circuitry. The water supply valve may allow or block the supply of water to the tub from an external water supply source. The water supply valve may include a solenoid valve configured to open and close in response to an electrical signal.

The washing machine may include the detergent supply device configured to supply detergent to the tub. The detergent supply may include a manual detergent supply that requires a user to input detergent to be used for each washing, and an automatic detergent supply that stores a large amount of detergent and automatically inputs a predetermined amount of detergent during washing. The detergent supply may include a detergent box for storing detergent. The detergent supply may be configured to supply detergent into the tub during a water supply process. Water supplied through the water supply pipe may be mixed with detergent via the detergent supply. Water mixed with detergent may be supplied into the tub. Detergent is used as a term including detergent for pre-washing, detergent for main washing, fabric softener, bleach, etc., and the detergent box may be partitioned into a storage region for the pre-washing detergent, a storage region for the main washing detergent, a storage region for the fabric softener, and a storage region for the bleach.

The washing machine may include a drainage configured to discharge water contained in the tub to the outside. The drainage may include a drain pipe extending from a bottom of the tub to the outside of the housing, a drain valve disposed on the drain pipe to open and close the drain pipe, and a pump disposed on the drain pipe. The pump may pump water from the drain pipe to the outside of the housing.

The washing machine may include a control panel disposed on one side of the housing. The control panel may provide a user interface for interaction between a user and the washing machine. The user interface may include at least one input interface and at least one output interface.

The at least one input interface may convert sensory information received from a user into an electrical signal.

The at least one input interface may include a power button, an operation button, a course selection dial (or a course selection button), and a washing/rinsing/spin-drying setting button. The at least one input interface may include a tact switch, a push switch, a slide switch, a toggle switch, a micro switch, a touch switch, a touch pad, a touch screen, a jog dial, and/or a microphone.

The at least one output interface may visually or audibly transmit information related to the operation of the washing machine to a user.

For example, the at least one output interface may transmit information related to a washing course, operation time of the washing machine, and washing/rinsing/spin-drying settings to the user. Information about the operation of the washing machine may be output through a screen, an indicator, or voice. The at least one output interface may include a Liquid Crystal Display (LCD) panel, a Light Emitting Diode (LED) panel, or a speaker.

The washing machine may include a communication module for wired and/or wireless communication with an external device.

The communication module may include at least one of a short-range wireless communication module and a long-range wireless communication module.

The communication module may transmit data to an external device (e.g., a server, a user device, and/or a home appliance) or receive data from the external device. For example, the communication module may establish communication with a server and/or a user device and/or a home appliance, and transmit and receive various types of data.

For the communication, the communication module may establish a direct (e.g., wired) communication channel or a wireless communication channel between external devices, and support the performance of the communication through the established communication channel. According to an embodiment, the communication module may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, and a server on a mobile communication network.

According to an embodiment, the communication module may communicate with an external device such as a server, a user device and other home appliances through an access point (AP). The access point (AP) may connect a local area network (LAN), to which a washing machine or a user device is connected, to a wide area network (WAN) to which a server is connected. The washing machine or the user device may be connected to the server through the wide area network (WAN). The control circuitry may control various components of the washing machine (e.g., the drive motor, and the water supply valve). The control circuitry may control various components of the washing machine to perform at least one operation including water supply, washing, rinsing, and/or spin-drying according to a user input. For example, the control circuitry may control the drive motor to adjust the rotational speed of the drum or control the water supply valve of the water supply to supply water to the tub.

The control circuitry may include hardware such as a CPU or memory, and software such as a control program. For example, the control circuitry may include at least one memory for storing an algorithm and program-type data for controlling the operation of components in the washing machine, and at least one processor configured to perform the above-mentioned operation by using the data stored in the at least one memory. The memory and the processor may each be implemented as separate chips. The processor may include one or more processor chips or may include one or more processing cores. The memory may include one or more memory chips or one or more memory blocks. Alternatively, the memory and the processor may be implemented as a single chip.

Hereinafter, a washing machine according to embodiments of the disclosure will be described in detail with reference to the accompanying drawings.

Figure 2:
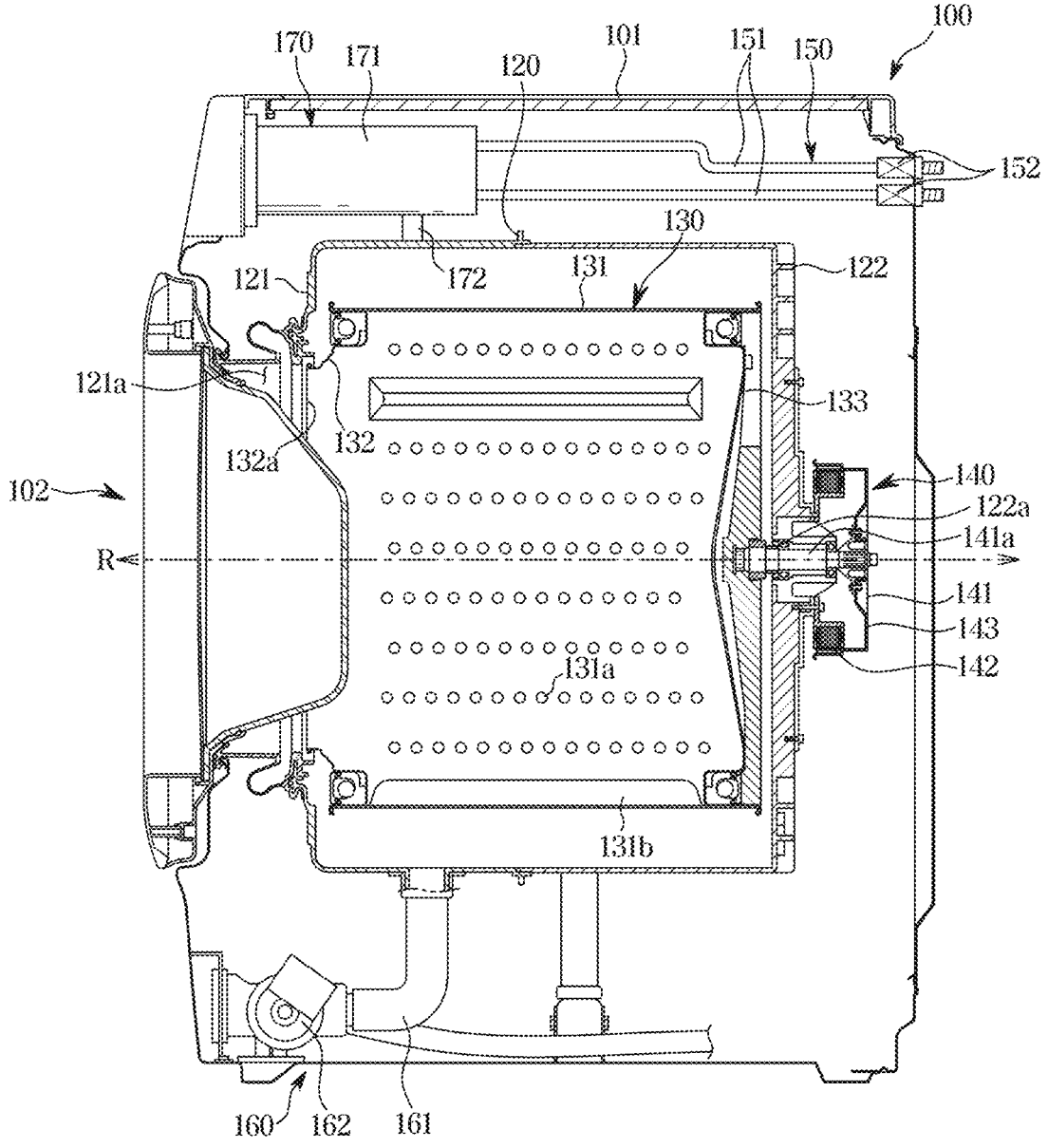
FIG. 2 is a side cross-sectional view of a washing machine according to an embodiment.

FIG. 1 illustrates an exterior of a washing machine according to an embodiment. FIG. 2 is a side cross-sectional view of a washing machine according to an embodiment.

Referring to FIG. 1 and FIG. 2, the washing machine 100 may be a drum-type washing machine that rotates a drum 130 and causes laundry to repeat rising and falling to wash the laundry. The washing machine 100 may be a motor-operated washing machine that uses a water current generated by a pulsator when the drum 130 rotates to wash the laundry.

That is, a method for controlling the washing machine 100 according to the disclosure is applicable to both the drum-type washing machine and the motor-operated washing machine. However, in the embodiments described below, the drum-type washing machine is described as an example of the washing machine 100 for description.

Referring to FIG. 1 and FIG. 2, the washing machine 100 may include a cabinet 101. The washing machine 100 may further include a door 102, a user interface 110, a tub 120, the drum 130, a driver 140, a water supply 150, a drainage 160, and a detergent supply 170, all of which are accommodated in the cabinet 101.

The cabinet 101 may have an opening 101*a* formed in a front side thereof, through which laundry may be inserted and withdrawn.

The opening 101*a* may be provided with the door 102. The door 102 may be rotatably mounted on the front side of the cabinet 101 by a hinge.

The opening 101*a* may be opened or closed by the door 102, and the closing of the opening 101*a* by the door 102 may be detected by a door switch 103. In response to the opening 101*a* being closed to start operating the washing machine 100, the door 102 may be locked by a door lock 104.

On an upper front side of the cabinet 101, the user interface 110 includes an input interface for receiving a user input for the washing machine 100 from a user and a display for displaying operation information of the washing machine 100.

The tub 120 may be provided inside the cabinet 101, and may accommodate water for washing and/or rinsing.

The tub 120 may include tub front parts 121 having an opening 121*a* formed on a front side, and tub rear parts 122 having a cylindrical shape with a closed rear side.

The opening 121*a* for putting laundry into the drum 130 provided in the tub 120 or taking laundry out of the drum 130 may be provided on a front side of the tub front parts 121. A bearing 122*a* for rotatably fixing a motor 141 may be provided on a rear wall of the tub rear parts 122.

The drum 130 may be provided inside the tub 120 to be rotatable about a rotation axis R extending in a front and back direction, and may accommodate laundry.

The drum 130 may include a drum body 131 having a cylindrical shape, a drum front part 132 provided in front of the drum body 131, and a drum rear part 133 provided in a rear of the drum body 131.

An inner surface of the drum body 131 may be provided with through holes 131*a* connecting an inside of the drum 130 and an inside of the tub 120, and a lifter 131*b* for lifting laundry to an upper portion of the drum 130 while the drum 130 rotates. The drum front part 132 may be provided with an opening 132*a* for putting laundry into or taking laundry out of the drum 130. The drum rear part 133 may be connected to a shaft 141*a* of the motor 141 that rotates the drum 130.

The driver 140 may include the motor 141 rotating the drum 130.

The motor 141 may be provided outside the tub rear part 122 of the tub 120, and may be connected to the drum rear part 133 of the drum 130 through the shaft 141*a*. The shaft 141*a* penetrates the tub rear part 122 and is rotatably supported by the bearing 122*a* provided in the tub rear part 122.

The motor 141 may include a stator 142 fixed to the outside of the tub rear part 122 and a rotor 143 that is rotatable and connected to the shaft 141*a*. The rotor 143 may rotate by magnetic force interaction with the stator 142, and the rotation of the rotor 143 may be transmitted to the drum 130 through the shaft 141*a*.

For example, the motor 141 may include a Permanent Magnet Synchronous Motor (PMSM) or Brushless Direct Current (BLDC) motor with easy to control a rotation speed.

The water supply 150 may supply water to the tub 120.

The water supply 150 may include a water supply pipe 151 connected to an external water supply source to supply water to the tub 120, and a water supply valve 152 provided on the water supply pipe 151.

The water supply pipe 151 is provided above the tub 120 and may extend from the external water supply source to a detergent box 171. Water may be guided to the tub 120 through the detergent box 171.

The water supply valve 152 may allow or block the supply of water from the external water supply source to the tub 120 in response to an electrical signal. The water supply valve 152 may include, for example, a solenoid valve that opens and closes in response to an electrical signal.

The drainage 160 may discharge water accommodated in the tub 120 and/or the drum 130 to the outside.

The drainage 160 includes a drain pipe 161 provided below the tub 120 and extending from the tub 120 to the outside of the cabinet 101, and a drain pump 162 provided on the drain pipe 161. The drain pump 162 may pump water in the drain pipe 161 to the outside of the cabinet 101.

The detergent supply 170 may supply detergent to the tub 120 and/or the drum 130.

The detergent supply 170 may include the detergent box 171 provided above the tub 120 to store detergent, and a mixing pipe 172 connecting the detergent box 171 to the tub 120.

The detergent box 171 may be connected to the water supply pipe 151, and water supplied through the water supply pipe 151 may be mixed with detergent in the detergent box 171. A mixture of detergent and water may be supplied to the tub 120 through the mixing pipe 172.

Figure 3:
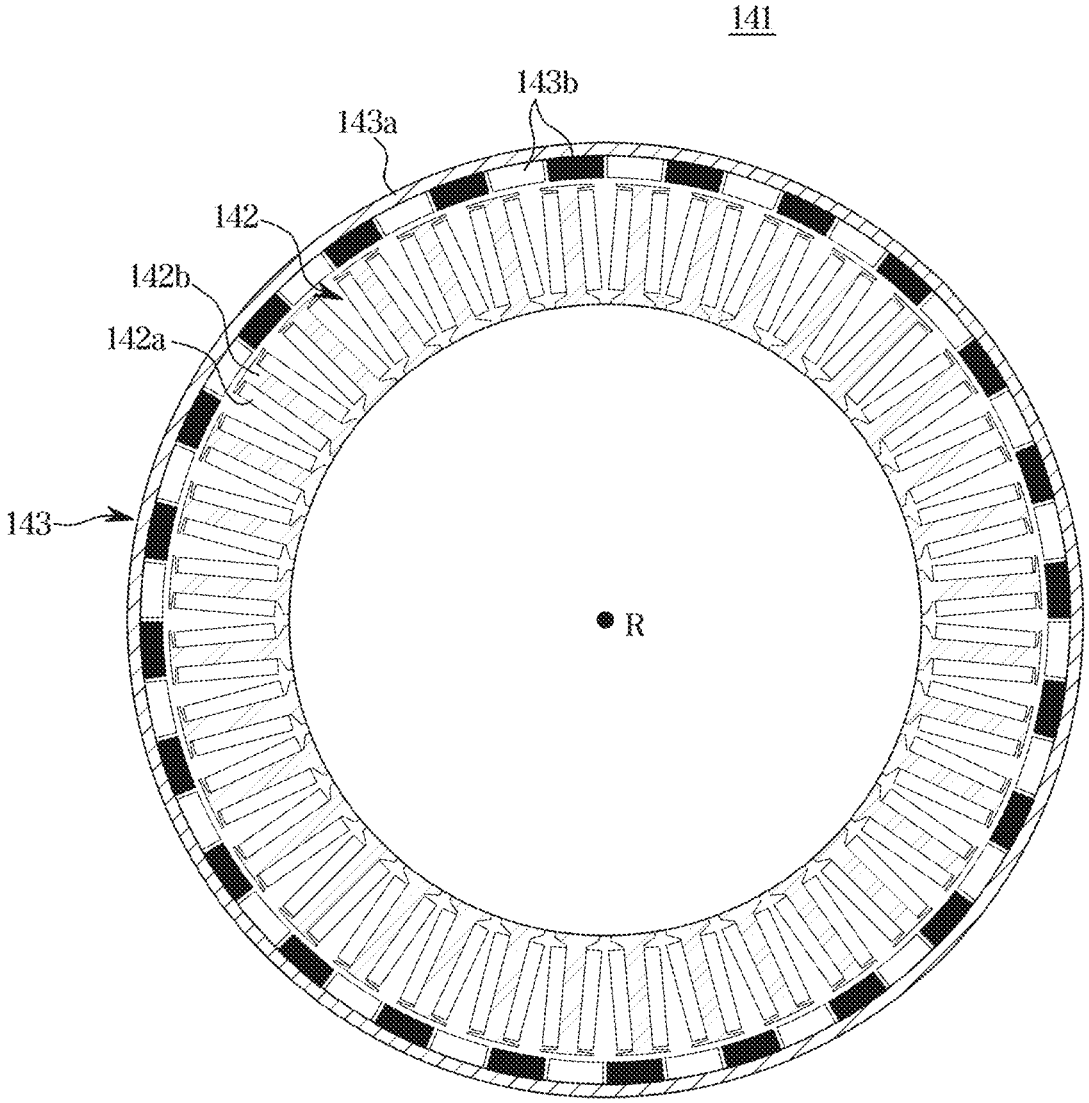
FIG. 3 illustrates a motor of a washing machine according to an embodiment.

FIG. 3 illustrates a motor of a washing machine according to an embodiment.

Referring to FIG. 3, the motor 141 may include the stator 142 and the rotor 143. In an embodiment, the motor 141 may be provided with the rotor 143 on a diametrically outer side of one stator 142.

In an embodiment, the rotor 143 may be connected to the drum 130.

The rotor 143 shares a coil 142*a* of the stator 142, and the motor 141 may rotate the rotor 143 by receiving current (e.g., three-phase current or six-phase current) from the coil 142*a*.

In an embodiment, the rotor 143 may be disposed outside the stator 142.

In various embodiments, the rotor 143 may be disposed inside the stator 142.

The rotor 143 is a cylindrical member with a flat bottom, and may include a rotor yoke 143*a* erected around a periphery of the bottom and a plurality of magnets 143*b* made of arc-shaped permanent magnets.

According to various embodiments, the 48 magnets 143*b* may be arranged so that N and S poles are alternately arranged continuously in a circumferential direction, and may be fixed to an inner surface of the rotor yoke 143*a*.

The stator 142 may be formed as a ring-shaped member whose outer diameter is smaller than an inner diameter of the rotor 143. The stator 142 may be provided with a plurality of teeth 142*b*, coils 142*a*, etc., embedded in resin. According to various embodiments, the stator 142 may be provided with 36 I-shaped teeth 142*b* and coils 142*a*.

The teeth 142*b* may be a thin plate-shaped steel member whose longitudinal cross-section has the shape of I, and may be arranged around the entire circumference of the stator 142 such that each is radially arranged at equal intervals. The inner and outer circumferential side ends of the teeth 142*b* may protrude in a flange shape from both ends in the circumferential direction.

The coil 142*a* may be formed for each tooth 142*b* by continuously winding a plurality of wires (e.g., six wires) coated with an insulating material in a predetermined order and configuration. The group of teeth 142*b* on which the coil 142*a* is formed may be embedded with a thermosetting resin by molding with only each diameter side end surface exposed, and may be fixed in a regular arrangement in an insulated state.

According to various embodiments, each coil 142*a* may be formed by winding each of six wires around each of the 36 I-shaped teeth 142*b* in a predetermined order.

The stator 142 and the rotor 143 are attached so that an end of the tooth 142*b* on the rotor 143 side faces the magnet 143*b* with a small gap.

The motor 141 according to an embodiment may be designed to include 36 slots S of the stator 142 and 48 poles P of the rotor 143.

As described above, the rotor 143 may be connected to the shaft 141*a*, and thus the rotor 143 may be connected to the drum 130.

The washing machine 100 according to an embodiment may include not only the mechanical components described with reference to FIG. 1 and FIG. 2, but also electrical/electronic components described below.

Figure 4:
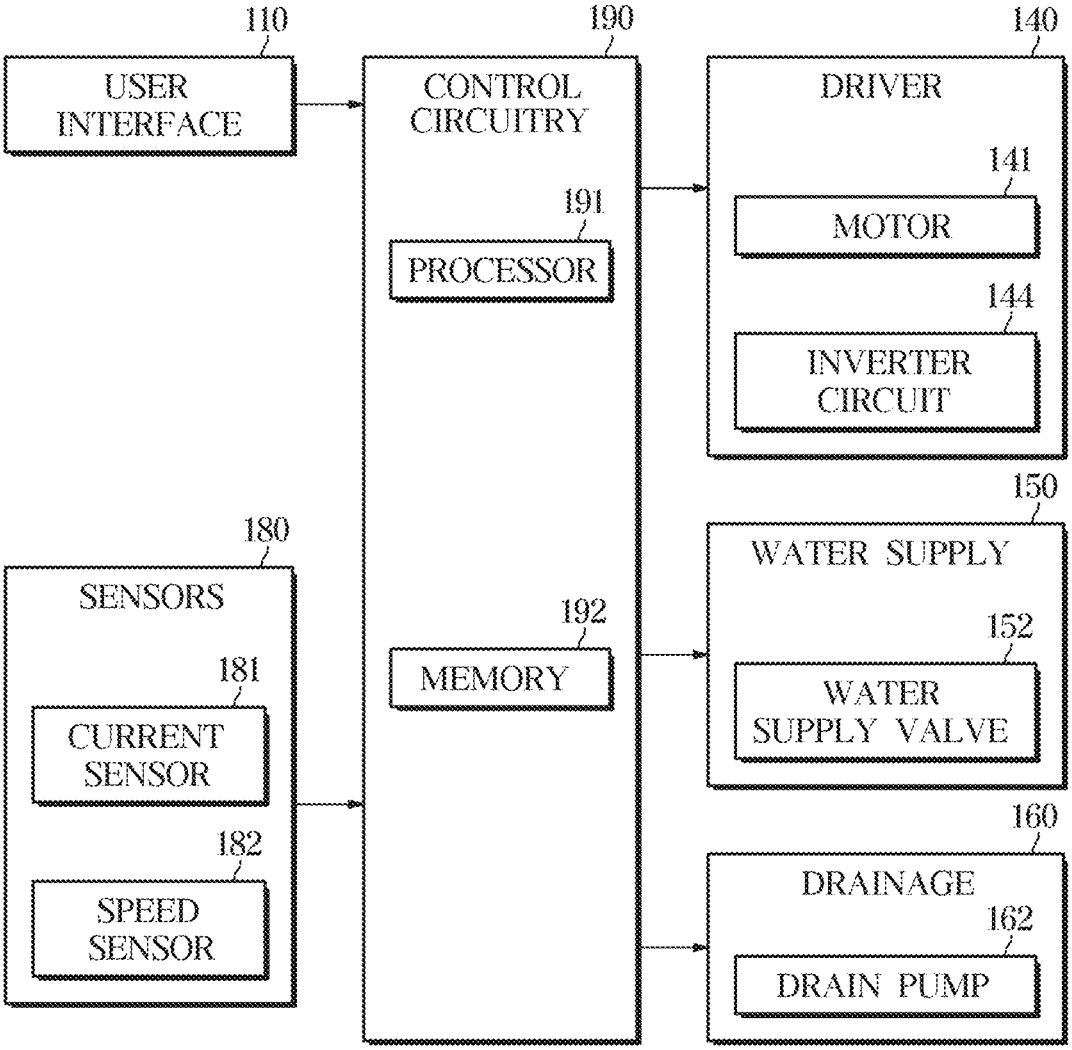
FIG. 4 is a control block diagram illustrating a washing machine according to an embodiment.

FIG. 4 is a control block diagram illustrating a washing machine according to an embodiment.

Referring to FIG. 4, the washing machine 100 may include the user interface 110, the driver 140, the water supply 150, the drainage 160, a sensors 180, and a control circuitry 190.

The user interface 110 may include an input button for obtaining a user input, and a display for displaying washing settings and/or washing operation information in response to the user input. For example, the input button may include a power button, an operation button, a course selection dial, and a detailed settings button. The display may include a screen for displaying the washing course selected by the rotation of the course selection dial and operation time of the washing machine 100, and an indicator for displaying the detailed settings selected by the setting button. The input button and the display may be separately provided or may be integrated as a touch screen.

Here, the washing courses may include washing settings (e.g., washing temperature, the number of times of rinsing, strength of spin-drying, etc.) set in advance by a designer of the washing machine 100 according to kinds (e.g., bedding, underwear, etc.) and materials (e.g., wool, etc.) of laundry. For example, standard washing may include washing settings capable of being applied to most of laundry, and bedding washing may include washing settings optimized to wash bedding. The washing courses may be divided into, for example, standard washing, intense washing, delicate clothes washing, bedding washing, baby clothes washing, towel washing, small washing, boiling washing, power saving washing, outdoor clothes washing, rinsing/spin-drying, spin-drying, and the like.

The sensors 180 may detect data indicating a state of the washing machine 100. The data detected by the sensors 180 may be transmitted to the control circuitry 190.

For example, the sensors 180 may include a current sensor 181. The current sensor 181 may detect a current value supplied to the motor 141, and the number of current sensors 181 is not limited. In addition, the current sensor 181 may be disposed anywhere as long as it may detect a current supplied to the motor 141. For example, the current sensor 181 may be provided in all three-phase circuits to measure all three-phase currents, but according to embodiments, the current sensor 181 may be provided only in two-phase circuits among the three-phase circuits. Motor current information detected by the current sensor 181 may be transmitted to the control circuitry 190.

In addition, the sensors 180 may include a speed sensor 182. The speed sensor 182 may detect a speed of the rotor 143 of the motor 141. The speed sensor 182 may include an encoder, Hall sensor, or resolver. Rotor speed information detected by the speed sensor 182 may be transmitted to the control circuitry 190.

The driver 140 may supply a driving current for driving the motor 141 to the motor 141 in response to a control signal from the control circuitry 190.

The driver 140 may drive the motor 141 through an inverter circuit 144. The inverter circuit 144 may include an inverter including a plurality of switching element pairs. The inverter may convert direct current power into direct current driving power or alternating current driving power, and may supply three-phase driving current to the motor 141. The inverter circuit 144 may include two switching elements (Q1 and Q2, Q3 and Q4, Q5 and Q6), wherein each of the switching element pairs (Q1 and Q2, Q3 and Q4, Q5 and Q6) is connected in series with each other. The switching elements (Q1, Q2, Q3, Q4, Q5, Q6) included in the inverter circuit 144 may be turned on/off according to a control signal from the control circuitry 190, and the three-phase driving current ($I_a$, $I_b$, $I_c$) may be supplied to the motor 141 according to the turn-on/turn-off of the switching elements (Q1, Q2, Q3, Q4, Q5, Q6).

The driver 140 may include a rectifier circuit and a DC link circuit in addition to the inverter circuit 144. The rectifier circuit may include a diode bridge including a plurality of diodes, and may rectify AC power of an external power source. The DC link circuit may include a DC link capacitor storing electrical energy, and may remove ripple of rectified power and output DC power.

The control circuitry 190 may be electrically connected to the user interface 110, the driver 140, the water supply 150, the drainage 160, and the sensors 180.

The control circuitry 190 may include a processor 191 generating a control signal for controlling operations of the washing machine 100, and a memory 192 storing a program and data for generating a control signal for controlling operations of the washing machine 100.

The processor 191 and the memory 192 may be implemented in separate semiconductor devices or in a single semiconductor device. In addition, the control circuitry 190 may include a plurality of processors 191 and a plurality of memories 192.

The processor 191 may process data and/or signals according to the program provided from the memory 192, and provide a control signal to each component of the washing machine 100 based on a result of the processing.

The processor 191 may receive a user input from the user interface 110, and may process the user input.

The processor 191 may output a control signal to control the motor 141, the water supply valve 152, the drain pump 162, and the door lock in response to the user input. For example, the processor 191 may control the motor 141, the water supply valve 152, the drain pump 162, and the door lock to sequentially perform a wash process, rinse process, and spin-dry process. In addition, the processor 191 may output a control signal for controlling the user interface 110 to display washing settings and washing operation information in response to the user input.

The processor 191 may include an arithmetic circuit, a memory circuit and a control circuit. The processor 191 may include a single chip or a plurality of chips. Also, the processor 191 may include a single core or a plurality of cores.

The memory 192 may store a program for performing a washing operation according to a washing course, and data including settings for the operation according to the washing course. Also, the memory 192 may store a currently selected washing course and washing settings based on a user input.

The memory 192 may include a volatile memory, such as Static Random Access Memory (SRAM) or Dynamic Random Access Memory (DRAM), and a non-volatile memory, such as Read Only Memory (ROM) or Erasable Programmable Read Only Memory (EPROM). The memory 192 may include a single memory or a plurality of memories.

The control circuitry 190 may use a predetermined command signal and a carrier wave consisting of a triangle wave to input a pulse width modulated (PWM-controlled) electrical signal to the inverter circuit 144, and may apply a DC voltage to the motor 141. Each of the switching elements (Q1, Q2, Q3, Q4, Q5, Q6) of the inverter circuit 144 may be turned on or off based on the electrical signal (PWM control signal) output from the control circuitry 190, thereby adjusting the power supplied to the motor 141 by a combination of turn-on and turn-off.

The control circuitry 190 may adjust the electrical signal (PWM control signal), input to the inverter circuit 144, to allow the drum 130 to rotate at a target speed, based on the target speed of the drum 130 calculated from the motor current detected by the current sensor 181 or a rotor speed detected by the speed sensor 182.

Figure 5:
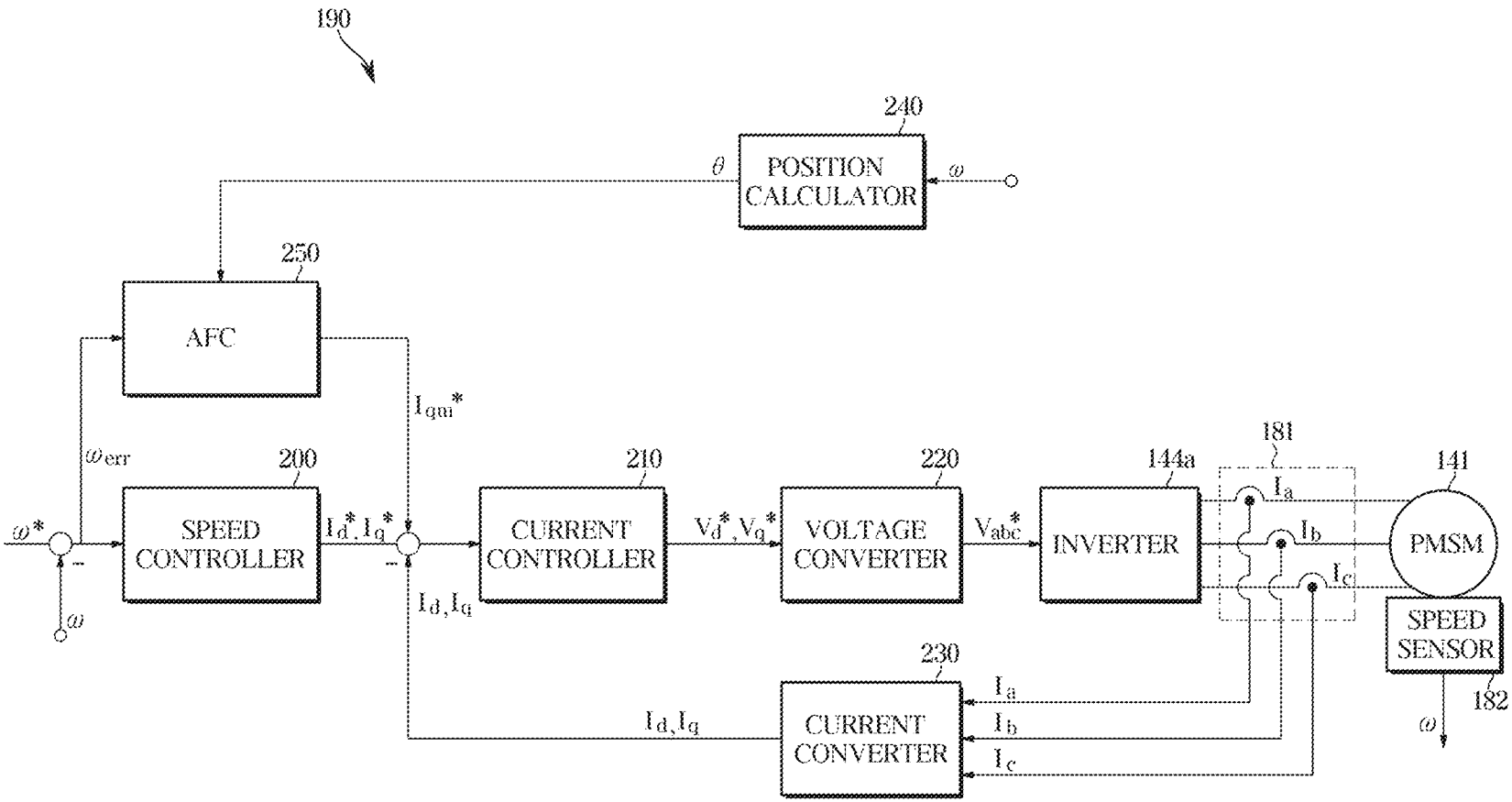
FIG. 5 is a control block diagram illustrating a control circuitry of a washing machine according to an embodiment.

FIG. 5 is a control block diagram illustrating a control circuitry of a washing machine according to an embodiment.

Referring to FIG. 5, the control circuitry 190 and the motor 141 are connected via an inverter 144*a* of the inverter circuit 144. The inverter 144*a* may transmit a driving voltage to the motor 141 based on an electrical signal output from the control circuitry 190. An operation of the rotor 143 of the motor 141 may be controlled based on the driving voltage transmitted from the inverter.

The current sensor 181 may be connected to the inverter 144*a*. The current sensor 181 may detect a current flowing in each phase of the inverter 144*a*. The current sensor 181 may detect a three-phase current labe (a-phase current, b-phase current, c-phase current) output from the inverter 144*a*. The current sensor 181 may transmit the detected three-phase current value to the control circuitry 190. The current sensor 181 may measure only two-phase current among the three-phase current labe, and the control circuitry 190 may estimate the other phase current from the two-phase current.

The speed sensor 182 for detecting a speed of the rotor 143 may be connected to the motor 141. The speed sensor 182 may detect the speed of the rotor 143 of the motor 141. The speed sensor 182 may transmit the detected speed value ω of the rotor 143 to the control circuitry 190. The speed sensor 182 may be implemented as a Hall sensor, encoder, resolver, and the like. Instead of the speed sensor 182, a position sensor detecting a position θ of the rotor 143 may be used. In this instance, the control circuitry 190 may estimate the speed value ω of the rotor 143 by differentiating the rotor position value detected by the position sensor.

The control circuitry 190 may include a speed controller 200, a current controller 210, a voltage converter 220, a current converter 230, a position calculator 240, and an Active Feedforward Controller (AFC, 250).

The speed controller 200 may compare a speed command ω* of the control circuitry 190 and the speed value ω of the rotor 143, and may output a d-axis current command $I_{d*}$ and a q-axis current command $I_{q*}$ based on the comparison result. For example, the speed controller 200 may calculate the d-axis current command $I_{d*}$ and the q-axis current command $I_{q*}$ of the rotor 143, based on a speed error ($\omega_{err}=\omega^*-\omega$) by using a Proportional Integral control (PI control). Here, the speed error is a difference between the speed command $\omega^*$ of the rotor 143 and the speed value $\omega$ of the rotor 143.

The current controller 210 may compare the d-axis current command $I_{d*}$ and the q-axis current command $I_{q*}$, output from the speed controller 200, a d-axis current value $I_d$ and a q-axis current value $I_q$, output from the current converter 230, and a q-axis current command compensation value $I_{qm*}$ output from the AFC 250. The current controller 210 may output a d-axis voltage command $V_{d*}$ and a q-axis voltage command $V_{q*}$ based on the comparison result. Specifically, the current controller 210 may identify the d-axis voltage command $V_{d*}$ based on a difference between the d-axis current command $I_{d*}$ and the d-axis current value $I_d$ by using the Proportional Integral (PI) control. The current controller 210 may identify the q-axis voltage command $V_{q*}$ based on a difference among the q-axis current command $I_{q*}$, the q-axis current value $I_q$, and the q-axis current command compensation value $I_{qm*}$.

The voltage converter 220 may convert the d-axis voltage command $V_{d*}$ and the q-axis voltage command $V_{q*}$, output from the current controller 210, into three-phase voltage command $V_{abc*}$ (a-phase voltage command, b-phase voltage command, c-phase voltage command), and may output the three-phase voltage command $V_{abc*}$ to the inverter 144*a*. In this instance, the control circuitry 190 may generate a PWM control signal from the three-phase voltage command $V_{abc*}$ using a PWM generator, and may output the PWM control signal to the inverter 144*a*.

The current converter 230 may convert the three-phase current value $I_{abc}$, detected by the current sensor 181, into the d-axis current value $I_d$ and the q-axis current value $I_q$, and may output to the current controller 210.

The position calculator 240 may convert the speed value $\omega$, detected by the speed sensor 182, into the position value $\theta$ of the rotor 143. For example, the position calculator 240 may be implemented as an integrator.

The AFC 250 may be connected in parallel between an input node of the speed controller 200 and an input node of the current controller 210.

The AFC 250 may receive the speed error value ($\omega_{err}=\omega^*-\omega$) of the rotor 143 and the position value $\theta$ of the rotor 143.

The AFC 250 may output the q-axis current command compensation value $I_{qm*}$ for compensating the q-axis current command value $I_{q*}$, based on the speed error value ($\omega_{err}=\omega^*-\omega$) of the rotor 143 and the position value $\theta$ of the rotor 143.

The AFC 250 may output the q-axis current command compensation value $I_{qm*}$ for offsetting an $m^{th}$-order harmonic component included in the q-axis current command value $I_{q*}$, based on the position value $\theta$ of the rotor 143 and the $m^{th}$-order harmonic component filtered by a bandpass filter from the speed error value ($\omega_{err}=\omega^*-\omega$) of the rotor 143. In this instance, m may be a natural number. The AFC 250 may output the q-axis current command compensation value $I_{qm*}$ to an input node of the current controller 210 to compensate for the q-axis current command value $I_{q*}$.

Figure 6:
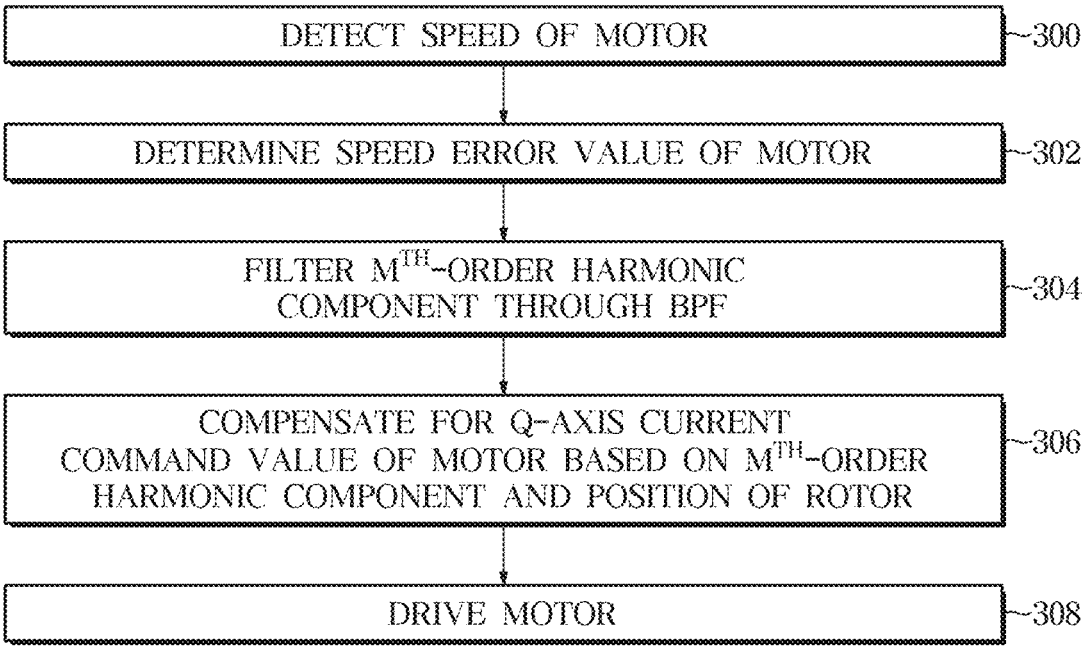
FIG. 6 is a flowchart illustrating a method for controlling a washing machine according to an embodiment.

FIG. 6 is a flowchart illustrating a method for controlling a washing machine according to an embodiment.

Referring to FIG. 6, the control circuitry 190 may detect a speed of the motor 141 (300).

The control circuitry 190 may detect the speed of the motor 141 through the speed sensor 182. Meanwhile, the control circuitry 190 may detect the speed of the motor 141 through the current sensor 181 instead of the speed sensor 182. In this instance, the control circuitry 190 may convert the three-phase current value $I_{abc}$, detected by the current sensor 181, into the d-axis current value $I_d$ and the q-axis current value $I_q$, and may identify the speed of the motor 141 based on the d-axis current value $I_d$ and the q-axis current value $I_q$. The control circuitry 190 may estimate the speed of the motor 141 from a motor modeling equation using the d-axis current value $I_d$ and the q-axis current value $I_q$ of the motor 141. For example, the speed and position of the motor 141 may be identified using sensorless vector control.

The control circuitry 190 may determine a speed error value of the motor 141 based on a speed command of the motor 141 and a motor speed value detected by the speed sensor 182 (302).

The control circuitry 190 may determine the speed error value ($\omega_{err}=\omega^*-\omega$) from the speed command $\omega^*$ of the rotor 143 and the speed value $\omega$ of the rotor 143.

The control circuitry 190 may filter a preset $m^{th}$-order harmonic component (m is a natural number) from the speed error value of the motor 141 through a bandpass filter (304).

The control circuitry 190 may compensate for a q-axis current command value of the motor 141 based on the filtered $m^{th}$-order harmonic component and position information $\theta$ of the rotor 143 (306).

The control circuitry 190 may drive the motor 141 based on the compensated q-axis current command value (308).

In an existing technology, cogging torque occurs due to magnetic force interaction between the stator 142 and the rotor 143 of the motor 141, this cogging torque generates torque ripple in the form of a specific harmonic component, causing motor torque fluctuations and motor noise. Also, the motor noise is greatly amplified when the noise coincides with a natural resonance frequency of a surrounding structure connected to the motor 141.

In an embodiment, the control circuitry 190 may filter a harmonic component of specific order from the speed error value of the rotor 143 through the bandpass filter, may compensate for the q-axis current command value of the motor 141 based on the filtered harmonic component of specific order and the position information $\theta$ of the rotor 143, and may drive the motor based on the compensated q-axis current command value, thereby offsetting the harmonic component of specific order which occurs due to the cogging torque of the motor 141 and is included in the q-axis current command value of the motor. As a result, the motor noise may be reduced, and the amplification of the motor noise occurring when the noise coincides with the natural resonance frequency of surrounding structure connected to the motor may be reduced.

Figure 7:
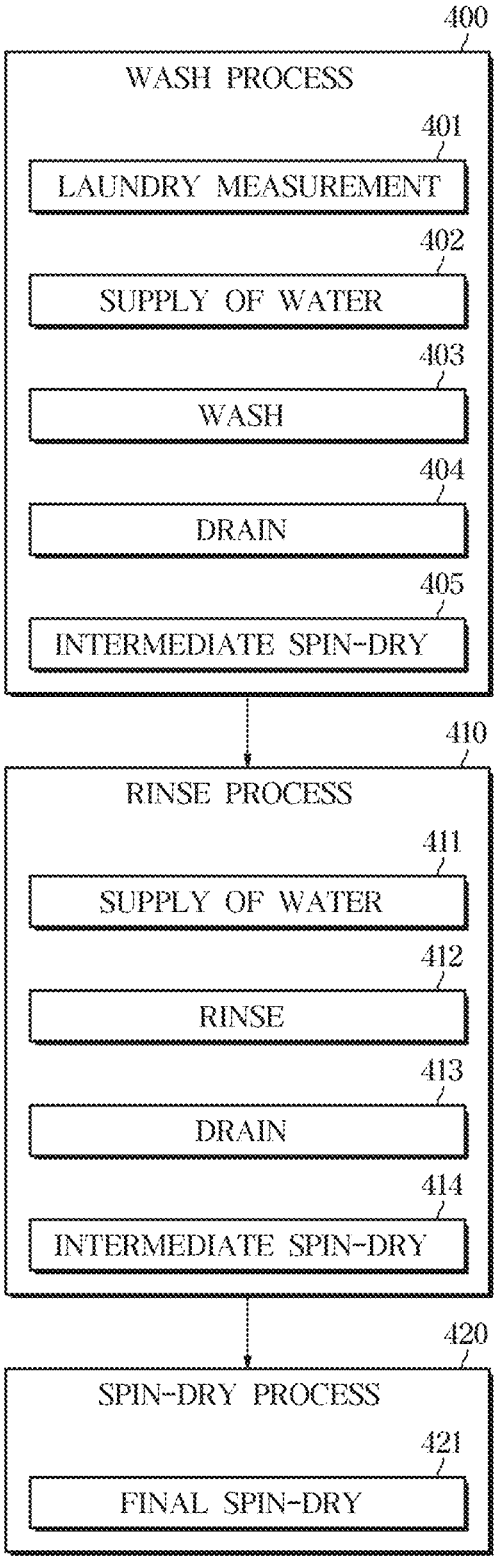
FIG. 7 illustrates an example of an operational cycle of a washing machine according to an embodiment.

FIG. 7 illustrates an example of an operational cycle of a washing machine according to an embodiment.

Referring to FIG. 7, the washing machine 100 may sequentially perform a wash process 400, a rinse process 410, and a spin-dry process 420 according to a user input.

By the wash process 400, laundry may be washed. Specifically, foreign substances attached to laundry may be separated by a chemical action of detergent and/or mechanical action, such as falling.

The wash process 400 may include a laundry measurement 401 for measuring the amount of laundry, a supply of water 402 for supplying water to the tub 120, a wash 403 for washing laundry by rotating the drum 130 at a low speed, a drain 404 for discharging water accommodated in the tub 120, and an intermediate spin-dry 405 for separating water from laundry by rotating the drum 130 at high speed.

For the wash 403, the control circuitry 190 may control the driver 140 to rotate the motor 141 in a forward direction (e.g., clockwise) or reverse direction (e.g., counterclockwise). By the rotation of the drum 130, the laundry falls from the upper side of the drum 130 to the lower side, and thus the laundry may be washed by falling.

For the intermediate spin-dry 405, the control circuitry 190 may control the driver 140 to rotate the motor 141 at high speed. By the high-speed rotation of the drum 130, water may be separated from the laundry accommodated in the drum 130, and thus discharged to the outside of the washing machine 100.

By the rinse process 410, the laundry may be rinsed. Specifically, detergent or foreign substances left on laundry may be washed away with water.

The rinse process 410 may include a supply of water 411 for supplying water to the tub 120, a rinse 412 for rinsing laundry by driving the drum 130, a drain 413 for discharging water accommodated in the tub 120, and an intermediate spin-dry 414 for separating water from laundry by driving the drum 130.

The supply of water 411, the drain 413, and the intermediate spin-dry 414 of the rinse process 410 may be the same as the supply of water 402, the drain 404, and the intermediate spin-dry 405 of the wash process 400, respectively. During the rinse process 410, the supply of water 411, the rinse 412, the drain 413, and the intermediate spin-dry 414 may be performed once or several times.

By the spin-dry process 420, laundry may be dehydrated. Specifically, water may be separated from the laundry by a high-speed rotation of the drum 130, and the separated water may be discharged to the outside of the washing machine 100.

The spin-dry process 420 may include a final spin-dry 421 in which the drum 130 is rotated at high speed to separate water from the laundry. Due to the final spin-dry 421, the last intermediate spin-dry 414 of the rinse process 410 may be omitted.

For the final spin-dry 421, the control circuitry 190 may control the driver 140 to rotate the motor 141 at high speed. By the high-speed rotation of the drum 130, water may be separated from the laundry accommodated in the drum 130 and discharged to the outside of the washing machine 100. In addition, a rotational speed of the motor 141 may increase in a stepwise manner.

Because the operation of the washing machine 100 ends with the final spin-dry 421, an operation time of the final spin-dry 421 may take longer than an operation time of the intermediate spin-dry 405 and 414.

The washing machine 100 may perform a wash process 400, a rinse process 410, and a spin-dry process 420 to wash laundry. In particular, during intermediate spin-dry 405 and 414 and final spin-dry 421, the washing machine 100 may increase a rotation speed of the motor 141 that rotates the drum 130 in a stepwise manner.

The spin-dry process described throughout the specification may refer to the intermediate spin-dry 405 performed in the wash process 400, the intermediate spin-dry 414 performed in the rinse process 410, and the final spin-dry 421 performed in the spin-dry process 420. Hereinafter, however, for convenience of description, the spin-dry process is assumed to be the final spin-dry 421 of the spin-dry process 420 performed after the rinse process 410.

The washing machine 100 according to an embodiment may filter the preset $m^{th}$-order harmonic component (m is a natural number) from the speed error value of the rotor 143 through the bandpass filter during the spin-dry process, may compensate for the q-axis current command value of the motor 141 based on the position information θ of the rotor 143 and the filtered $m^{th}$-order harmonic component, and may drive the motor based on the compensated q-axis current command value. In this instance, the washing machine 100 may compensate for the q-axis current command value of the motor 141 in response to a speed of the rotor 143 being within a preset speed range during the spin-dry process.

Figure 8:
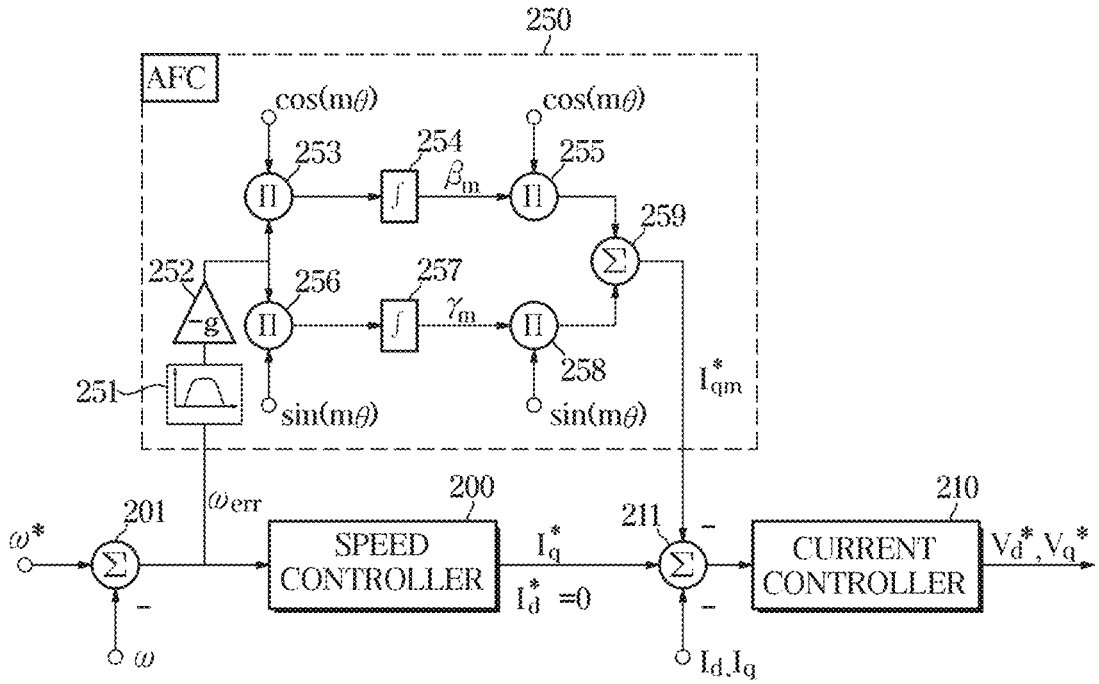
FIG. 8 illustrates an Active Feedforward Controller (AFC) of a control circuitry of a washing machine according to an embodiment.

FIG. 8 illustrates an AFC of a control circuitry of a washing machine according to an embodiment.

Referring to FIG. 8, the AFC 250 may be connected in parallel between an input node 201 of the speed controller 200 and an input node 211 of the current controller 210, and may compensate for the q-axis current command value $I_{q*}$ output from the speed controller 200 to the current controller 210.

The AFC 250 may output the q-axis current command compensation value $I_{qm*}$ for offsetting the $m^{th}$-order harmonic component included in the q-axis current command value $I_{q*}$, based on the position value θ of the rotor 143 and the $m^{th}$-order harmonic component filtered by the bandpass filter from the speed error value $\omega_{err}$ of the rotor 143.

The AFC 250 may include the bandpass filter 251, an AFC gainer 252, a first multiplier 253, a first integrator 254, a second multiplier 255, a third multiplier 256, a second integrator 257, a fourth multiplier 258, and an adder 259.

The bandpass filter 251 may filter the preset $m^{th}$-order harmonic component from the speed error value $\omega_{err}$ of the rotor 143. For example, an output of the bandpass filter 251 may be $BPF(\omega_{err})$. Here, m may be a natural number. For example, m may be a multiple of 12.

The AFC gainer 252 may apply a preset gain value (−g) to the $m^{th}$-order harmonic component filtered by the bandpass filter 251 and may output the applied value. In this instance, the AFC gain g may be a value corresponding to the number of slots of the motor 141. For example, an output of the AFC gainer 252 may be $\omega_{errmth}(\omega_{err\ mth}=BPF(\omega_{err})*(-g))$.

The first multiplier 253 may multiply the output of the AFC gainer 252 by the $m^{th}$-order cos(mθ) with respect to the position θ of the rotor 143, and may output the multiplied value. An output of the first multiplier 253 may be $BPF(\omega_{err})*(-g)*\cos(m\theta)$.

The first integrator 254 may integrate the output of the first multiplier 253 and output the integrated value. An output of the first integrator 254 may be $\beta_m(\beta_m=\int(\omega_{errmth}*\cos(m\theta))$. $\beta_m$ may be an adaptation parameter of the AFC.

The second multiplier 255 may multiply the $m^{th}$-order cos(mθ) by the output of the first integrator 254 and output the multiplied value. An output of the second multiplier 255 may be $I_q\beta_m(I_q\beta_m=\beta_m*\cos(m\theta))$.

The third multiplier 256 may multiply the output of the AFC gainer 252 by the $m^{th}$-order sin(mθ) with respect to the position θ of the rotor 143 and output the multiplied value. An output of the third multiplier 256 may be $BPF(\omega_{err})*(-g)*\sin(m\theta)$.

The second integrator 257 may integrate the output of the third multiplier 256 and output the integrated value. An output of the second integrator 257 may be $\gamma_m(\gamma_m=\int(\omega_{errmth}*\sin(m\theta))$. $\gamma_m$ may be an adaptation parameter of the AFC.

The fourth multiplier 258 may multiply the $m^{th}$-order sin(mθ) by the output of the second integrator 257 and output the multiplied value. An output of the fourth multiplier 258 may be $I_q\gamma_m(I_q\gamma_m=\gamma_m*\sin(m\theta))$.

The adder 259 may add the output of the second multiplier 255 and the output of the fourth multiplier 258, and output the summed value. An output of the adder 259 may be $I_{qm*}((I_{qm*}=I_q\beta_m+I_q\gamma_m)$.

The adder 259 may output $I_{qm*}$ to the input node 211 of the current controller 210.

The $I_{qm*}$ output by the AFC 250 may be the q-axis current command compensation value for compensating for the q-axis current command value $I_{q*}$. The q-axis current command compensation value $I_{qm*}$ may offset the $m^{th}$-order harmonic component included in the q-axis current command value $I_{q*}$.

The q-axis current command compensation value $I_{qm*}$ may be a harmonic current value.

The q-axis current command compensation value $I_{qm*}$ may be a harmonic current value for generating a reaction harmonic torque with respect to a target harmonic torque. The q-axis current command compensation value $I_{qm*}$ may be a harmonic current value for generating a reaction harmonic torque that is equal to but opposite in direction to the target harmonic torque.

The q-axis current command compensation value $I_{qm*}$ may be a harmonic current value for offsetting the $m^{th}$-order harmonic torque of the motor 141.

The q-axis current command compensation value $I_{qm*}$ may be a harmonic current value for offsetting the harmonic torque of cogging torque of the motor 141. The q-axis current command compensation value $I_{qm*}$ may be a harmonic current value for offsetting the $m^{th}$-order harmonic torque of the cogging torque of the motor 141.

In response to the AFC 250 outputting the q-axis current command compensation value $I_{qm*}$ to the input node 211 of the current controller 210, the current controller 210 may output the q-axis voltage command value $V_{q*}$ based on the q-axis current command $I_{q*}$ that is obtained by subtracting the q-axis current command compensation value $I_{qm*}$ and the q-axis current value $I_q$ from the q-axis current command $I_{q*}$ that is output from the speed controller 200. In this instance, the control circuitry 190 may fix the d-axis current command value $I_{d*}$, which does not contribute to torque generation of the motor, to 0, and may control only the q-axis current command $I_{q*}$. In this case, the current controller 210 may output the d-axis voltage command value $V_{d*}$ based on the d-axis current value $I_d$.

The q-axis current command $I_{q*}$ output from the speed controller 200 to the current controller 210 includes a specific harmonic component due to cogging torque. Accordingly, the q-axis current command $I_{q*}$ may be a waveform including harmonic components rather than a sinusoidal waveform. As such, in a case where the motor 141 may be driven based on the q-axis current command $I_{q*}$ in the form of a waveform including harmonic components, motor noise may occur. However, according to the disclosure, the q-axis current command value $I_{q*}$ may be compensated using the q-axis current command compensation value $I_{qm*}$ thereby offsetting a harmonic component of a specific order included in the q-axis current command value $I_{q*}$ and maintaining the q-axis current command $I_{q*}$ in the form of a sinusoidal waveform. As a result, motor noise may be reduced.

The number of slots of the stator 142 of the motor 141 of the washing machine 100 is highly related to the harmonic component of the cogging torque generated by the motor 141. Changes in the number of slots may affect a form of the harmonic component of the cogging torque. For example, in a case where the number of slots is 12, the $12^{th}$-order harmonic component may appear distinctly among the harmonic components. In a case where the number of slots is 24, the $24^{th}$-order harmonic component may appear distinctly. In a case where the number of slots is 36, the $36^{th}$-order harmonic component may appear distinctly. In a case where the number of slots is 48, the $48^{th}$-order harmonic component may appear distinctly.

For example, in the motor 141 shown in FIG. 3, because the number of slots of the stator 142 is 36, the $36^{th}$-order harmonic component appears distinctly among the harmonic components of the cogging torque, and the $36^{th}$-order harmonic component may mainly affect the motor noise.

Figure 9:
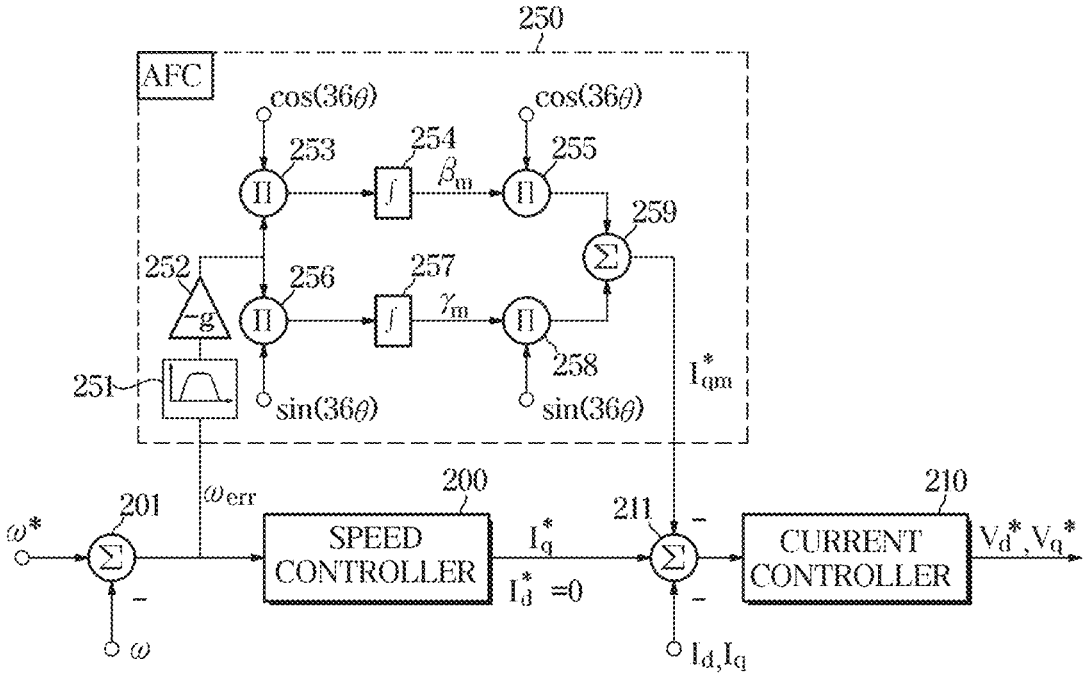
FIG. 9 illustrates an example of an AFC of a control circuitry of a washing machine according to an embodiment.

FIG. 9 illustrates an example of an AFC of a control circuitry of a washing machine according to an embodiment.

Referring to FIG. 9, the AFC 250 may output the q-axis current command compensation value $I_{qm*}$ for offsetting the $36^{th}$-order harmonic component.

The output of the first multiplier 253 may be $BPF(\omega_{err})*(-g)*\cos(36\theta)$.

The output of the first integrator 254 may be $\beta_{36th}(\beta_{36th}=\int(\omega_{err36th}*\cos(36\theta))$.

The output of the second multiplier 255 may be $I_q\beta_{36th}$ $(I_q\beta_{36th}=\beta_{36th}*\cos(36\theta))$.

The output of the third multiplier 256 may be $BPF(\omega_{err})*(-g)*\sin(36\theta)$.

The output of the second integrator 257 may be $\gamma_{36th}$ $(\gamma_{36th}=\int(\omega_{err36th}*\sin(36\theta))$.

The output of the fourth multiplier 258 may be $I_q\gamma_{36th}$ $(I_q\gamma_{36th}=\gamma_{36th}*\sin(36\theta))$.

The output of the adder 259 may be $I_{qm*}((I_{qm*}=I_q\beta_{36th}+I_q\gamma_{36th})$.

The q-axis current command compensation value $I_{qm*}$ output by the AFC 250 may offset the $36^{th}$-order harmonic component included in the q-axis current command value $I_{q*}$.

Figure 10:
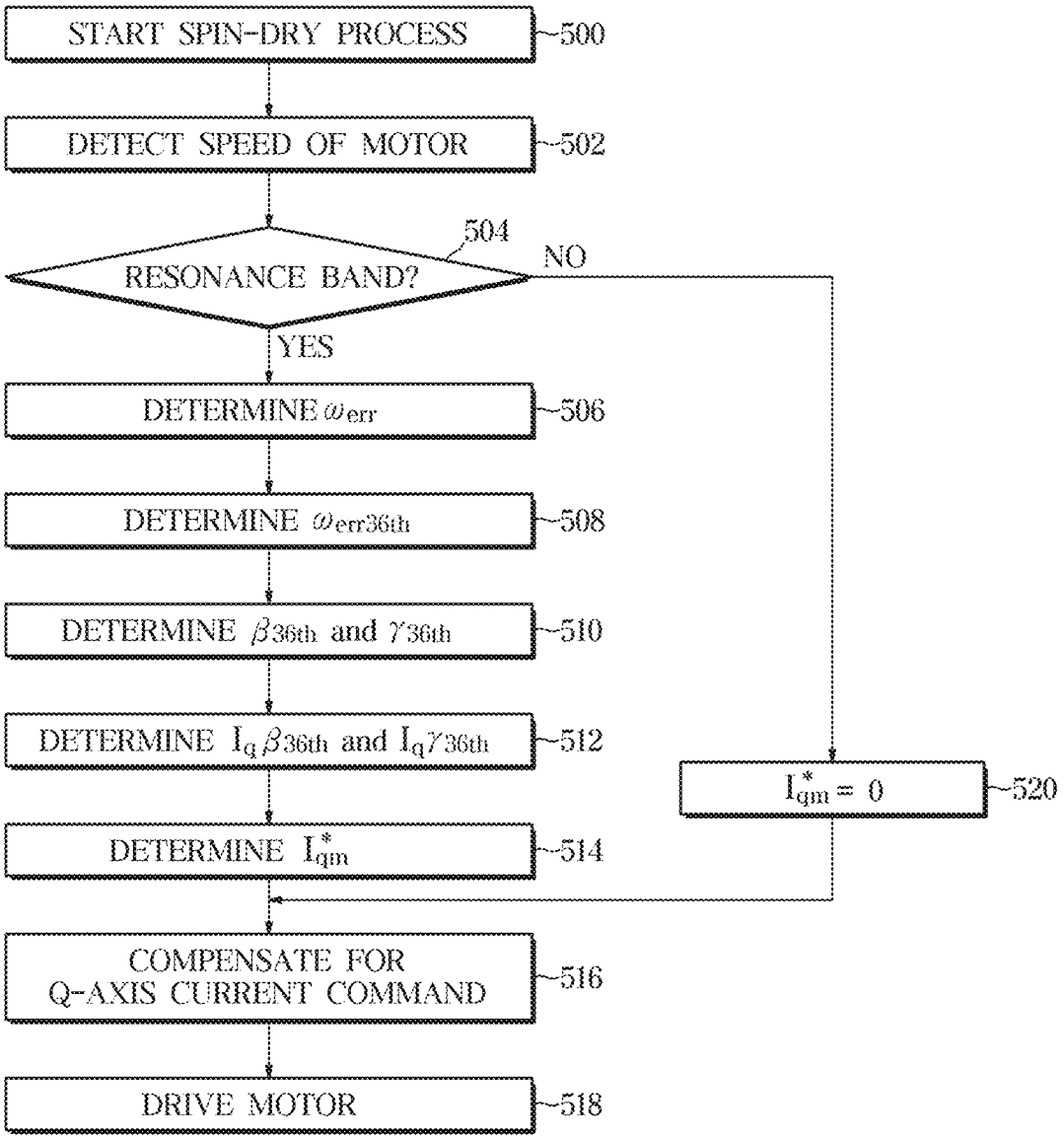
FIG. 10 is a flowchart illustrating operations of offsetting a $36^{th}$-order harmonic component included in a q-axis current command of a motor in a washing machine according to an embodiment.

FIG. 10 is a flowchart illustrating operations of offsetting a $36^{th}$-order harmonic component included in a q-axis current command of a motor in a washing machine according to an embodiment.

Referring to FIG. 10, the control circuitry 190 may start a spin-dry process according to a spin-dry profile (500). To perform the spin-dry process, the control circuitry 190 may rotate the drum 130 according to the spin-dry profile. The spin-dry profile may be pre-stored, or may be a spin-dry profile in which a stored spin-dry profile is changed based on factors such as a load of laundry.

The control circuitry 190 may detect a speed of the motor 141 through the speed sensor 182 during the spin-dry process (502).

The control circuitry 190 may identify whether the motor speed is in a resonance band (504).

The resonance band may be a resonance band of the washing machine. The resonance band may be a resonance band of the motor or a resonance band of a surrounding structure (e.g., the drum 130, the tub 120, etc.) to which the motor 141 is connected. Because the motor 141 is mounted on the tub 120, noise may be significantly increased by overlapping a natural frequency of the tub 120 and a rotation frequency of the motor 141. Accordingly, whether the motor speed is in the resonance band is required to be identified. A resonance band value may be a preset speed value or a preset speed range value. The resonance band value may be 500 rpm or a value in a range of 400 to 600 rpm. For example, in a case where the number of motor slots is 36, motor noise due to the $36^{th}$-order harmonic component occurs during a spin-dry process. In this instance, the motor noise may be greatly amplified when the motor noise coincides with a resonance frequency of the tub 120 at around 500 rpm.

In response to the motor speed being in the resonance band (Yes in operation 504), the control circuitry 190 may determine the speed error value $\omega_{err}$ of the motor 141 (506).

The control circuitry 190 may determine the speed error value ($\omega_{err}=\omega^*-\omega$) from the speed command $\omega^*$ of the rotor 143 of the motor 141 and the speed value $\omega$ of the rotor 143.

The control circuitry 190 may determine the $36^{th}$-order harmonic component $\omega_{err36th}$ filtered by the bandpass filter 251 that filters the $36^{th}$-order harmonic component from the speed error value $\omega_{err}$ (508).

The control circuitry 190 may determine, as the $36^{th}$-order harmonic component $\omega_{err36th}$ filtered by the bandpass filter 251, a value ($(BPF(\omega_{err})*(-g))$ obtained by applying the gain value (−g) of the AFC gainer 252 to the $36^{th}$-order harmonic component ($BPF(\omega_{err})$) of the speed error value $\omega_{err}$ passing through the bandpass filter 251.

The control circuitry 190 may determine $\beta_{36th}$ and $\gamma_{36th}$, which are $36^{th}$-order adaptation parameters of the AFC 250, based on the $36^{th}$-order harmonic component $\omega_{err36th}$ filtered by the bandpass filter 251 and the position $\theta$ of the rotor 143 (510).

The control circuitry 190 may determine $\beta_{36th}$ as $\int(\omega_{err36th}*\cos(36\theta)$. The control circuitry 190 may determine $\gamma_{36th}$ as $\int(\omega_{err36th}*\sin(36\theta))$.

The control circuitry 190 may determine $I_q\beta_{36th}$, which is a current compensation value based on $\beta_{36th}$, and $I_q\gamma_{36th}$ which is a current compensation value based on $\gamma_{36th}$ (512).

The control circuitry 190 may determine $I_q\beta_{36th}$ as $\beta_{36th}*\cos(36\theta)$. The control circuitry 190 may determine $I_q\gamma_{36th}$ as $\gamma_{36th}*\sin(36\theta)$.

The control circuitry 190 may determine the q-axis current command compensation value $I_{qm*}$ based on $I_q\beta_{36th}$ and $I_q\gamma_{36th}$ (514).

The control circuitry 190 may determine the q-axis current command compensation value $I_{qm*}$ by adding $I_q\beta_{36th}$ and $I_q\gamma_{36th}$ ($I_{qm*}=I_q\beta_{36th}+I_q\gamma_{36th}$).

The control circuitry 190 may compensate for the q-axis current command value by generating the q-axis current command compensation value $I_{qm*}$ (516).

The control circuitry 190 may drive the motor 141 based on the compensated q-axis current command value (518).

In response to the motor speed not being in the resonance band (No in operation 504), the control circuitry 190 may determine the q-axis current command compensation value $I_{qm*}$ to be 0 (520). Accordingly, the control circuitry 190 may drive the motor 141 based on the q-axis current command value that is not compensated.

As such, the control circuitry 190 may offset the $36^{th}$-order harmonic component included in the q-axis current command value $I_{q*}$ using the q-axis current command compensation value $I_{qm*}$ in the resonance band, thereby reducing motor noise.

Figure 11:
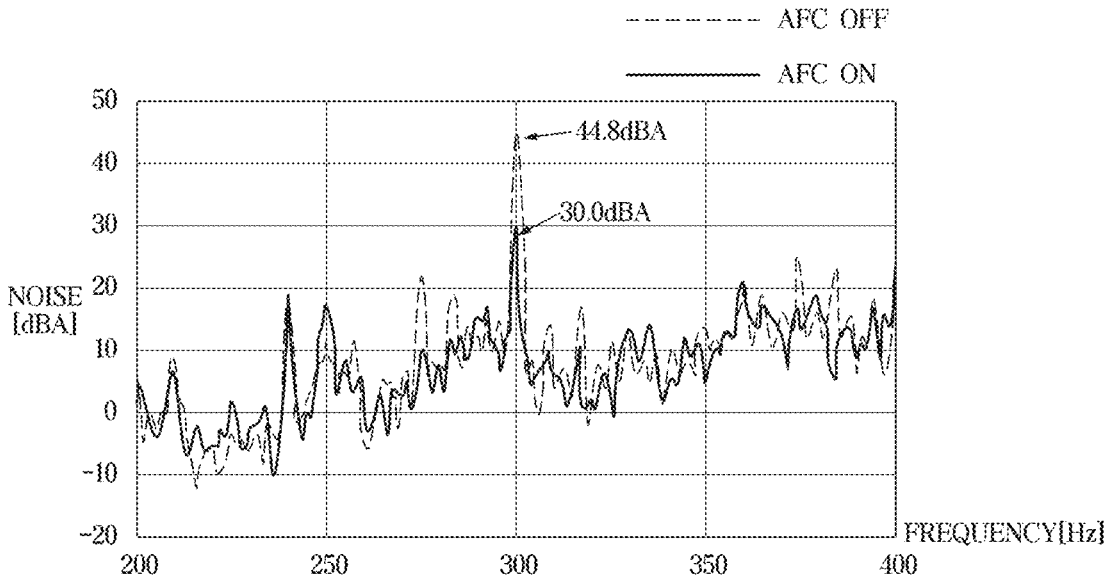
FIG. 11 illustrates changes in $36^{th}$-order noise component in an activated state and a deactivated state of an AFC in a washing machine according to an embodiment.

FIG. 11 illustrates changes in $36^{th}$-order noise component in an activated state and a deactivated state of an AFC in a washing machine according to an embodiment.

FIG. 11 illustrates results of Fast Fourier Transform (FFT) analysis measuring motor noise depending on whether the AFC 250 operates at 500 rpm (36 motor slots, 60 Hz). The FFT analysis result shows changes in the $36^{th}$-order noise component between the activated and deactivated states of the AFC 250.

In a case where the AFC 250 is deactivated (AFC off), the $36^{th}$-order noise component is 44.8 dBA at 300 Hz (500 rpm*36 slots/60 Hz), which indicates a noise level when the AFC 250 is not operating.

However, in a case where the AFC 250 is activated (AFC on), the $36^{th}$-order noise component is decreased to 30.0 dBA, lower than 44.8 dBA, which indicates that when the AFC 250 operates, the $36^{th}$-order noise level is lower than the previous state.

Accordingly, the $36^{th}$-order noise component is reduced by 14.8 dBA depending on whether the AFC 250 is activated, which indicates that the operation of the AFC 250 is effective in reducing $36^{th}$-order noise.

Figure 12:
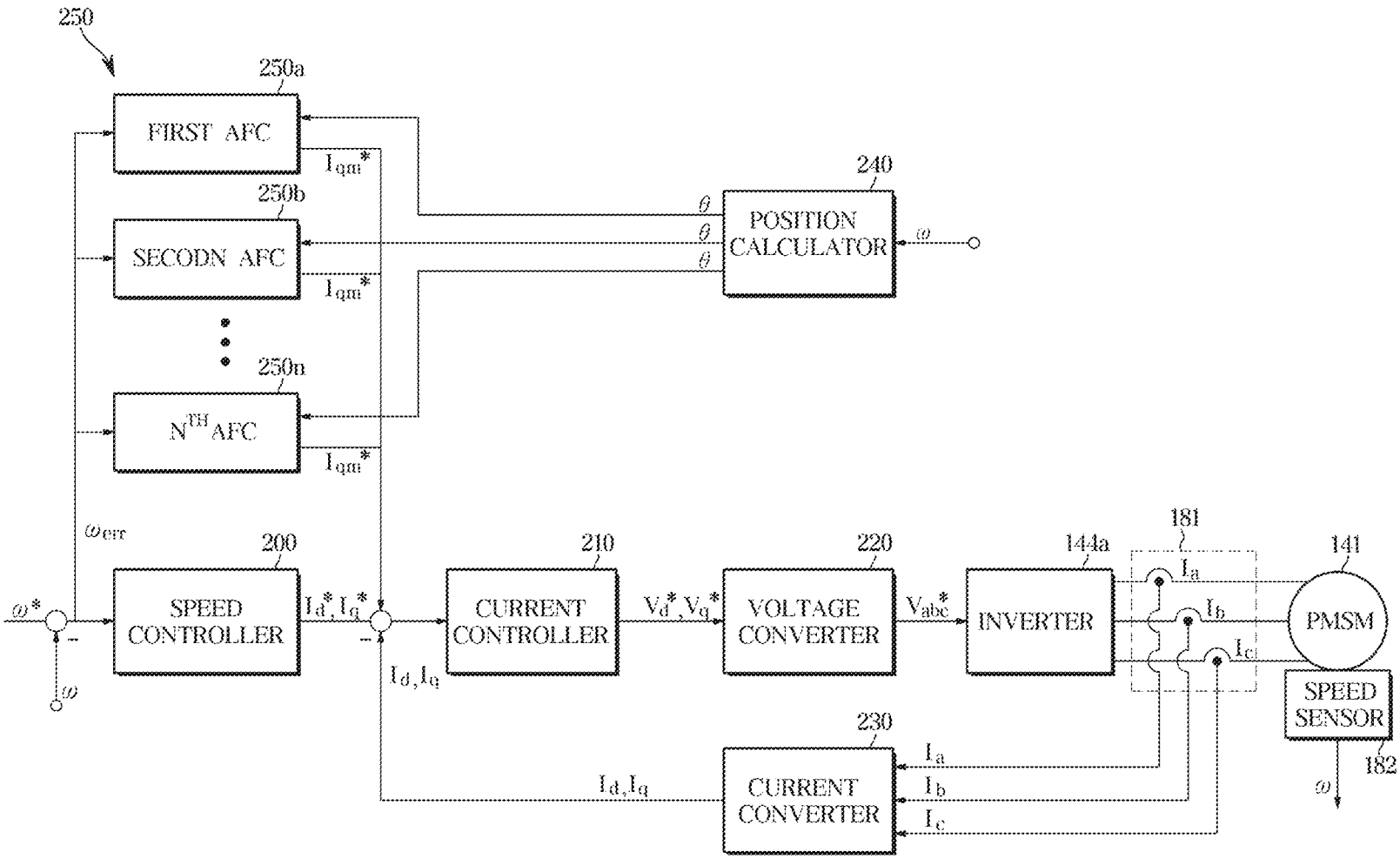
FIG. 12 is a control block diagram illustrating a control circuitry of a washing machine according to another embodiment.

FIG. 12 is a control block diagram illustrating a control circuitry of a washing machine according to another embodiment.

Referring to FIG. 12, the AFC 250 may include a plurality of AFCs, i.e., 250*a* to 250*n*.

In a case where multiple $m^{th}$-order harmonic components to be offset exists, a plurality of AFCs 250 equal to the number of harmonic components of a target order may be connected in parallel.

The control circuitry 190 may activate or deactivate all of the plurality of AFCs 250*a* to 250*n*.

Activating too many AFCs 250 unnecessarily may reduce motor control stability. Accordingly, the control circuitry 190 may activate some of the plurality of AFCs 250*a* to 250*n*, and may deactivate the others.

The control circuitry 190 may activate only one of the plurality of AFCs 250*a* to 250*n*, and may deactivate all of the others. Depending on an $m^{th}$-order harmonic component to be offset, the corresponding AFC may be selected and activated.

In the washing machine 100 with 36 motor slots, the $36^{th}$-order harmonic component is of interest, and thus in order to offset only the $36^{th}$-order harmonic component, only the AFC corresponding to the $36^{th}$-order harmonic component may be activated among the plurality of AFCs 205*a* to 250*n*, and the other AFCs may be deactivated. The activated AFC may extract only the $36^{th}$-order harmonic component by applying the bandpass filter from the speed error value, thereby preventing motor control stability from being decreased and reducing motor noise.

The control circuitry 190 may activate the AFC 250 only in the resonance band where the $36^{th}$-order noise occurs, thereby preventing the motor control stability from being affected in other bands. For example, the AFC 250 may be activated only in the 400 to 600 rpm band, and the AFC 250 may be deactivated in the remaining bands.

Figure 13:
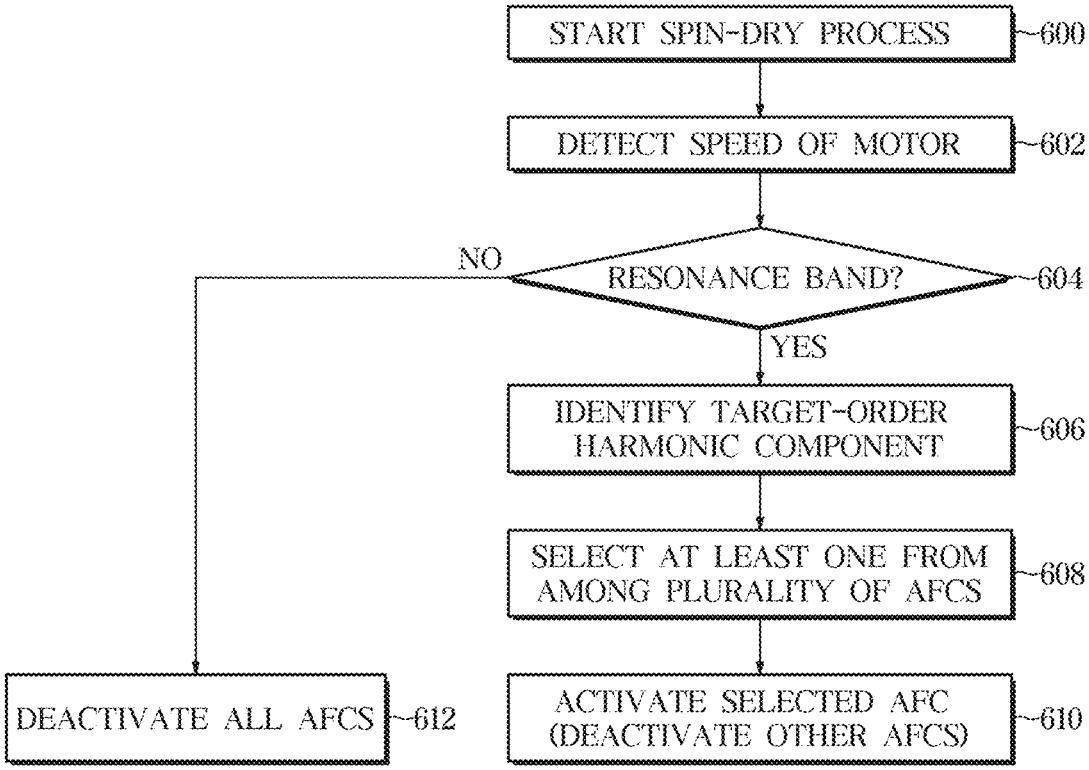
FIG. 13 is a flowchart illustrating operations of selecting and activating one of a plurality of AFCs in a washing machine according to another embodiment.

FIG. 13 is a flowchart illustrating operations of selecting and activating one of a plurality of AFCs in a washing machine according to another embodiment.

Referring to FIG. 13, the control circuitry 190 may start a spin-dry process according to a spin-dry profile (600). To perform the spin-dry process, the control circuitry 190 may rotate the drum 130 according to the spin-dry profile.

The control circuitry 190 may detect a speed of the motor 141 through the speed sensor 182 during the spin-dry process (602).

The control circuitry 190 may identify whether the motor speed is in a resonance band (604).

In response to the motor speed being in the resonance band (Yes in operation 604), the control circuitry 190 may identify a target-order harmonic component (harmonic component of a target order), which is a harmonic component of the order to be offset (606).

The control circuitry 190 may identify the number of slots of the motor 141 according to information about the motor 141 in the washing machine 100, and may identify the target-order harmonic component based on the number of motor slots. For example, in a case where the number of motor slots is 36, the target-order harmonic component may be identified as a $36^{th}$-order harmonic component.

The control circuitry 190 may select at least one AFC from among the plurality of AFCs 250*a* to 250*n* (608).

The control circuitry 190 may select the at least one AFC from the plurality of AFCs 250*a* to 250*n*, based on the target-order harmonic component. For example, in a case where the target-order harmonic component is a $36^{th}$-order harmonic component, an AFC for offsetting the $36^{th}$-order harmonic component may be selected from the plurality of AFCs 250*a* to 250*n*.

The control circuitry 190 may activate the selected AFC and deactivate the remaining AFCs (610).

In response to the motor speed not being in the resonance band (No in operation 604), the control circuitry 190 may deactivate all of the plurality of AFCs 250*a* to 250*n* (612).

The control circuitry 190 may activate the AFC 250 only in the resonance band where the $36^{th}$-order noise occurs, thereby preventing motor control stability from being affected in other bands. For example, the AFC 250 may be activated only in the 400 to 600 rpm band, and AFC 250 may be deactivated in the remaining bands.

According to the disclosure, harmonic components generated in a motor may be offset, thereby reducing motor noise.

According to the disclosure, by offsetting specific harmonic components generated by cogging torque of a motor, the motor noise may be reduced, and the motor noise, amplified when the motor noise coincides with a natural resonant frequency of surrounding structures connected to the motor, may be reduced.

According to an embodiment of the disclosure, the washing machine may include: a drum 130 configured to be rotatable inside a tub 120; a motor 141 including a stator 142 and a rotor 143, and configured to rotate the drum 130; an inverter circuit 144 connected to the motor 141; and at least one processor 191 configured to compensate for a q-axis current command value of the motor 141 based on an $m^{th}$-order harmonic component (m is a natural number) and a position of the rotor 143, and control the inverter circuit 144 to drive the motor 141 based on the compensated q-axis current command value, the $m^{th}$-order harmonic component being filtered by a bandpass filter from a speed error value of the rotor 143.

The at least one processor may be configured to determine a q-axis current command compensation value for offsetting the $m^{th}$-order harmonic component included in the q-axis current command value of the motor, and compensate for the q-axis current command value of the motor based on the q-axis current command compensation value.

The at least one processor may be configured to compensate for the q-axis current command value of the motor in response to a speed of the rotor being within a preset speed range during a spin-dry process.

The m may be a multiple of 12.

The m may be 36.

The at least one processor may include: a speed controller 200 configured to output the q-axis current command value $I_{q*}$ and a d-axis current command value $I_{d*}$ based on the speed error value of the rotor; a current controller 210 configured to output a q-axis voltage command value $V_{q*}$ and a d-axis voltage command value $V_{d*}$ based on the q-axis current command value $I_{q*}$ and the d-axis current command value $I_{d*}$ output from the speed controller; and an Active Feedforward Controller (AFC, 250) configured to output a q-axis current command compensation value for offsetting the $m^{th}$-order harmonic component included in the q-axis current command value $I_{q*}$ based on the position of the rotor and the $m^{th}$-order harmonic component filtered by the bandpass filter from the speed error value of the rotor.

The AFC may be configured to be connected in parallel between an input node of the speed controller and an input node of the current controller.

The AFC may include: a bandpass filter configured to filter the preset $m^{th}$-order harmonic component from the speed error value of the rotor, an AFC gainer 252 configured to apply a preset gain value to the $m^{th}$-order harmonic component filtered by the bandpass filter, a first multiplier 253 configured to multiply an output of the AFC gainer by an $m^{th}$-order $\cos(m\theta)$ with respect to the position $\theta$ of the rotor, a first integrator 254 configured to integrate an output of the first multiplier, a second multiplier 255 configured to multiply an output of the first integrator by the $m^{th}$-order $\cos(m\theta)$, a third multiplier 256 configured to multiply the output of the AFC gainer by an $m^{th}$-order $\sin(m\theta)$ with respect to a rotational position $\theta$ of the rotor, a second integrator 257 configured to integrate an output of the third multiplier, a fourth multiplier 258 configured to multiply an output of the second integrator by the $m^{th}$-order $\sin(m\theta)$, and an adder 259 configured to add an output of the second multiplier and an output of the fourth multiplier.

The at least one processor may be configured to activate the AFC in response to a speed of the rotor being within a preset speed range during a spin-dry process.

The preset speed range may include a resonance band of the washing machine.

The at least one processor may include: a speed controller configured to output the q-axis current command value $I_{q*}$ and the d-axis current command value $I_{d*}$ based on the speed error value of the rotor; a current controller configured to output a q-axis voltage command value $V_{q*}$ and a d-axis voltage command value $V_{d*}$ based on the q-axis current command value $I_{q*}$ and the d-axis current command value $I_{d*}$ output from the speed controller; and a plurality of AFCs configured to output a q-axis current command compensation value for offsetting the $m^{th}$-order harmonic component included in the q-axis current command value $I_{q*}$ based on the position of the rotor and the $m^{th}$-order harmonic component filtered by the bandpass filter from the speed error value of the rotor. The plurality of AFCs may each be configured to be connected in parallel between an input node of the speed controller and an input node of the current controller.

The at least one processor may be configured to identify a harmonic component of a target order based on the number of slots in the rotor, select at least one from the plurality of AFCs based on the harmonic component of the target order, and activate the at least one selected AFC and deactivate remaining AFCs.

The at least one processor may be configured to activate the selected AFC in response to a speed of the rotor being within a resonance band of the washing machine or the speed of the rotor being within a preset speed range during a spin-dry process.

According to an embodiment of the disclosure, a method for controlling a washing machine including a drum configured to be rotatable inside a tub, and a motor including a stator and a rotor and configured to rotate the drum, the method may include: filtering, by a bandpass filter, a preset $m^{th}$-order harmonic component (m is a natural number) from a speed error value of the rotor; compensating for a q-axis current command value of the motor based on the filtered $m^{th}$-order harmonic component and a position of the rotor; and driving the motor based on the compensated q-axis current command value.

The compensating of the q-axis current command value of the motor may include determining a q-axis current command compensation value for offsetting the $m^{th}$-order harmonic component included in the q-axis current command value of the motor, and compensating for the q-axis current command value of the motor based on the q-axis current command compensation value.

The compensating of the q-axis current command value of the motor may include compensating for the q-axis current command value of the motor in response to a speed of the rotor being within a preset speed range during a spin-dry process.

In the filtering of the preset $m^{th}$-order harmonic component, the m may be a multiple of 12.

The washing machine may include an AFC configured to output the q-axis current command compensation value for offsetting the $m^{th}$-order harmonic component based on the filtered $m^{th}$-order harmonic component and the position of the rotor. The compensating of the q-axis current command value of the motor may include activating the AFC in response to a speed of the rotor being within a preset speed range during a spin-dry process.

The compensating of the q-axis current command value of the motor may include activating the AFC in response to a speed of the rotor being within a resonance band of the washing machine during a spin-dry process.

The washing machine may include a plurality of AFCs configured to output a q-axis current command compensation value for offsetting the $m^{th}$-order harmonic component based on the position of the rotor and the $m^{th}$-order harmonic component filtered by the bandpass filter from the speed error value of the rotor. The compensating of the q-axis current command value of the motor may include identifying a harmonic component of a target order based on a number of slots in the rotor, selecting at least one from the plurality of AFCs based on the harmonic component of the target order, and activating the at least one selected AFC and deactivating remaining AFCs.

The disclosed embodiments may be implemented in the form of a recording medium that stores instructions executable by a computer. The instructions may be stored in the form of program codes, and when executed by a processor, the instructions may create a program module to perform operations of the disclosed embodiments.

The machine-readable recording medium may be provided in the form of a non-transitory storage medium. The term 'non-transitory storage medium' may mean a tangible device without including a signal (e.g., electromagnetic waves) and may not distinguish between storing data in the storage medium semi-permanently and temporarily. For example, the non-transitory storage medium may include a buffer that temporarily stores data.

The method according to the various embodiments of the disclosure may be provided in a computer program product. The computer program product may be a commercial product that may be traded between a seller and a buyer. The computer program product may be distributed in the form of a storage medium (e.g., a compact disc read only memory (CD-ROM)), through an application store (e.g., play store™), directly between two user devices (e.g., smartphones), or online (e.g., downloaded or uploaded). In the case of online distribution, at least part of the computer program product (e.g., a downloadable app) may be at least temporarily stored or arbitrarily created in a storage medium that may be readable to a device such as a server of the manufacturer, a server of the application store, or a relay server.

Although the disclosure has been shown and described in relation to specific embodiments, it would be appreciated by those skilled in the art that changes and modifications may be made in these embodiments without departing from the principles and scope of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine, comprising:

a drum configured to be rotatable inside a tub;

a motor comprising a stator and a rotor, and configured to rotate the drum;

an inverter circuit connected to the motor; and at least one processor configured to compensate for a q-axis current command value of the motor based on an $m^{th}$-order harmonic component (m is a natural number) and a position of the rotor, and control the inverter circuit to drive the motor based on the compensated q-axis current command value, the $m^{th}$-order harmonic component being filtered by a bandpass filter from a speed error value of the rotor.

2. The washing machine of claim 1, wherein the at least one processor is configured to determine a q-axis current command compensation value for offsetting the $m^{th}$-order harmonic component included in the q-axis current command value of the motor, and compensate for the q-axis current command value of the motor based on the q-axis current command compensation value.

3. The washing machine of claim 2, wherein the at least one processor is configured to compensate for the q-axis current command value of the motor in response to a speed of the rotor being within a preset speed range during a spin-dry process.

4. The washing machine of claim 1, wherein the m is a multiple of 12.

5. The washing machine of claim 4, wherein the m is 36.

6. The washing machine of claim 1, wherein the at least one processor comprises:

a speed controller configured to output the q-axis current command value $I_{q*}$ and a d-axis current command value $I_{d*}$ based on the speed error value of the rotor;

a current controller configured to output a q-axis voltage command value $V_{q*}$ and a d-axis voltage command value $V_{d*}$ based on the q-axis current command value $I_{q*}$ and the d-axis current command value $I_{d*}$ output from the speed controller; and an Active Feedforward Controller (AFC) configured to output a q-axis current command compensation value for offsetting the $m^{th}$-order harmonic component included in the q-axis current command value $I_{q*}$ based on the position of the rotor and the $m^{th}$-order harmonic component filtered by the bandpass filter from the speed error value of the rotor.

7. The washing machine of claim 6, wherein the AFC is connected in parallel between an input node of the speed controller and an input node of the current controller.

8. The washing machine of claim 6, wherein the AFC comprises:

the bandpass filter configured to filter a preset $m^{th}$-order harmonic component from the speed error value of the rotor, an AFC gainer configured to apply a preset gain value to the $m^{th}$-order harmonic component filtered by the bandpass filter, a first multiplier configured to multiply an output of the AFC gainer by an $m^{th}$-order cos(mθ) with respect to the position θ of the rotor, a first integrator configured to integrate an output of the first multiplier, a second multiplier configured to multiply an output of the first integrator by the $m^{th}$-order cos(mθ), a third multiplier configured to multiply the output of the AFC gainer by an $m^{th}$-order sin(mθ) with respect to a rotational position θ of the rotor, a second integrator configured to integrate an output of the third multiplier, a fourth multiplier configured to multiply an output of the second integrator by the $m^{th}$-order sin(mθ), and an adder configured to add an output of the second multiplier and an output of the fourth multiplier.

9. The washing machine of claim 6, wherein the at least one processor is configured to activate the AFC in response to a speed of the rotor being within a preset speed range during a spin-dry process.

10. The washing machine of claim 9, wherein the preset speed range includes a resonance band of the washing machine.

11. The washing machine of claim 1, wherein the at least one processor comprises:

a speed controller configured to output the q-axis current command value $I_{q*}$ and a d-axis current command value $I_{d*}$ based on the speed error value of the rotor;

a current controller configured to output a q-axis voltage command value $V_{q*}$ and a d-axis voltage command value $V_{d*}$ based on the q-axis current command value $I_{q*}$ and the d-axis current command value $I_{d*}$ output from the speed controller; and a plurality of AFCs configured to output a q-axis current command compensation value for offsetting the $m^{th}$-order harmonic component included in the q-axis current command value $I_{q*}$ based on the position of the rotor and the $m^{th}$-order harmonic component filtered by the bandpass filter from the speed error value of the rotor, and the plurality of AFCs are each connected in parallel between an input node of the speed controller and an input node of the current controller.

12. The washing machine of claim 11, wherein the at least one processor is configured to:

identify a harmonic component of a target order based on a number of slots in the rotor, select at least one from the plurality of AFCs based on the harmonic component of the target order, and activate the at least one selected AFC and deactivate remaining AFCs.

13. The washing machine of claim 12, wherein the at least one processor is configured to activate the selected AFC in response to a speed of the rotor being within a resonance band of the washing machine or the speed of the rotor being within a preset speed range during a spin-dry process.

14. A method for controlling a washing machine comprising a drum configured to be rotatable inside a tub, and a motor including a stator and a rotor and configured to rotate the drum, the method comprising:

filtering, by a bandpass filter, a preset $m^{th}$-order harmonic component (m is a natural number) from a speed error value of the rotor;

compensating for a q-axis current command value of the motor based on the filtered $m^{th}$-order harmonic component and a position of the rotor; and driving the motor based on the compensated q-axis current command value.

15. The method of claim 14, wherein the compensating of the q-axis current command value of the motor comprises:

determining a q-axis current command compensation value for offsetting the $m^{th}$-order harmonic component included in the q-axis current command value of the motor, and compensating for the q-axis current command value of the motor based on the q-axis current command compensation value.

16. The method of claim 15, further comprising:

compensating for the q-axis current command value of the motor in response to a speed of the rotor being within a preset speed range during a spin-dry process.

17. The method of claim 14, wherein the m is a multiple of 12.

18. The method of claim 17, wherein the m is 36.

19. The method of claim 14, further comprising:

outputting, using a speed controller, the q-axis current command value $I_{q*}$ and a d-axis current command value $I_{d*}$ based on the speed error value of the rotor;

outputting, using a current controller, a q-axis voltage command value $V_{q*}$ and a d-axis voltage command value $V_{d*}$ based on the q-axis current command value $I_{q*}$ and the d-axis current command value $I_{d*}$ output from the speed controller; and outputting, using an Active Feedforward Controller (AFC), a q-axis current command compensation value for offsetting the $m^{th}$-order harmonic component included in the q-axis current command value $I_{q*}$ based on the position of the rotor and the $m^{th}$-order harmonic component filtered by the bandpass filter from the speed error value of the rotor.

20. The method of claim 19, wherein the AFC is connected in parallel between an input node of the speed controller and an input node of the current controller.

* * * * *